US005735125A

United States Patent [19]

Tarelin et al.

[11] Patent Number: 5,735,125

[45] Date of Patent: Apr. 7, 1998

[54] STEAM CONDENSATION IN STEAM TURBINE

[76] Inventors: Anatoly O. Tarelin, ul. Komandarma Uberovycha 50 - 6, Apt. 114, Kharkiv - 129, Ukraine, 310129; Volodymyr P. Skliarov, ul. Korolenko 4, Yuzhny-2, Kharkiv Oblast, Ukraine, 412118; Yury I. Serhienko, Prospekt Traktorbudivelnykiv 77, Apt. 286, Kharkiv-120, Ukraine, 310120; Oleh Weres, P.O. Box 116, Vineburg, Calif. 95487

[21] Appl. No.: 589,420

[22] Filed: Jan. 22, 1996

[51] Int. Cl.[6] ..... F01B 31/16

[52] U.S. Cl. ..... 60/685

[58] Field of Search ..... 60/685, 687; 415/176

[56] References Cited

U.S. PATENT DOCUMENTS 2,333,031 10/1943 Miller ..... 60/685

4,206,013 6/1980 Dickey ..... 60/685

4,517,805 5/1985 Kals ..... 60/685

*Primary Examiner*—Noah P. Kamen

*Attorney, Agent, or Firm*—Harold D. Messner

[57] ABSTRACT

Drops of water in wet steam exiting a steam turbine are electrically charged. When exposed to a sufficiently strong electric field produced by suitably disposed electrodes (34, 85), the electrically charged water drops disintegrate into numerous small droplets, which serve as nuclei for internal condensation. Supersaturation of the steam is decreased, thereby decreasing the amount of water in the vapor phase, the condenser pressure, and the turbine backpressure. Electrostatic forces acting upon the charged water droplets decrease turbulence in the wet steam flow, further decreasing backpressure. The result is an increase in energy conversion efficiency and power output at constant fuel rate. A method and device for providing this beneficial result are provided.

33 Claims, 9 Drawing Sheets

STEAM CONDENSATION IN STEAM TURBINE

REFERENCES CITED

U.S. Patent Documents

None known.

Foreign Patent Documents

| Pat. No. | Issued | Country | |
|---|---|---|---|
| 1,677,483 A1 | 1/1989 | USSR | F28F 13/16 |
| 2,006,081 | 1/1994 | Russia | H01B 17/54 |
| Appl. No. 5047816/06 | 6/1992 | Russia | F28F 13/16 |
| 199,788 | 6/1923 | United Kingdom | |
| 1,070,712 | 12/1959 | Fed. Rep. Germany | |
| 940,400 | 10/1963 | United Kingdom | |

Other Publications

A. I. Grigoriev and S. O. Shiriaieva (1989). Zhurnal Tekhnicheskoi Fiziki, v.59, n.5, pp. 6–13.

L. B. Loeb (1958). Static Electrification. Springer-Verlag, Berlin.

L. B. Loeb (1965). Electrical coronas: their basic physical mechanisms. University of California Press, Berkeley.

G. Taylor (1964). Disintegration of water drops in an electric field. Proc. Royal Soc. (London), Series A, v. 280, pp. 383–397.

E. J. W. Verwey and J. Th. G. Overbeek (1948). Theory of the stability of lyophobic colloids: the interaction of sol particles having an electric double layer. Elsevier Publishing Co., Amsterdam, p. 29.

A. Yabe (1995) "Heat engineering", in J.-S. Chang, A. J. Kelly and J. M. Crowley (eds.), Handbook of electrostatic processes, Marcel Dekker, New York, pp. 555–580.

BACKGROUND OF THE INVENTION

1. Background—Field of Invention

This invention relates to a method and device which improve the condensation of steam and pattern of steam flow within the turbine neck and condenser of a steam turbine, thereby decreasing back-pressure and increasing the energy conversion efficiency of the turbine.

2. Background—Discussion of Prior Art

The power output and energy conversion efficiency of a steam turbine are determined largely by the decrease in the pressure and temperature of the steam as it flows through the turbine. Decreasing the turbine back pressure $P_B$ allows more energy to be taken from the steam and converted to useful mechanical or electrical work. Backpressure is related to the pressure measured near to the turbine exhaust, condenser pressure, and pressure loss in the turbine neck by the formula $$P_B \cong P_{TE} = P_{CN} + L_{TN} \quad (1)$$

Therefore, decreases in $P_{CN}$ and $L_{TN}$ have an additive effect upon $P_B$ and energy conversion efficiency.

The steam flowing out of the turbine usually is wet, consisting of water vapor and dispersed drops of liquid water. The water vapor is supercooled, and continues to condense on the water drops. This process of internal condensation decreases the amount of water in the gas phase, and therefore also the pressure of the wet steam. The flow velocity of the wet steam in the turbine neck may be as large as 100–200 m/sec and the turbine neck is only a few meters long. Therefore, the transit time from the last stage of the turbine to the condenser is only about 0.01–0.1 second. Because the liquid phase in the wet steam comprises relatively few relatively large drops, the time available is too short for the process of internal condensation to reach equilibrium. Because the process of internal condensation in the turbine neck does not reach equilibrium, $L_{TN}$ is larger than it would be if equilibrium were achieved.

Accordingly, increasing the number of water drops in the wet steam within the turbine neck by nucleating additional drops will improve internal condensation of the water vapor, and will tend to decrease $L_{TN}$ and $P_B$ and to increase power output. Improved internal condensation within the turbine neck will decrease the load placed upon the condenser, thereby also decreasing $P_{CN}$.

Due to its large velocity, steam in the turbine exhaust has significant kinetic energy; most of the kinetic energy is associated with the average flow velocity of the steam parallel to the axis of the turbine neck, but some kinetic energy is associated with turbulent eddies in the steam. Commonly, the turbine neck is designed to function as a diffuser. The cross-section of the turbine neck increases smoothly from the turbine to the condenser, and the average flow velocity decreases in proportion. The decrease in flow velocity corresponds to a large decrease in the kinetic energy of the steam, which is recovered as an increase of static pressure in the condenser relative to the turbine exhaust, decreasing $L_{TN}$. The kinetic energy associated with turbulent eddies is not recovered. Decreasing turbulence in the steam flow and converting part of the kinetic energy of the turbulent eddies to kinetic energy associated with the average flow will allow a greater amount of kinetic energy to be recaptured, further decreasing $L_{TN}$ and $P_B$.

USSR Authors' Certificate 1,677,483 A1 (filed by A. E. Khinevych, A. O. Tarelin, N. V. Surdu, I. L. Ivanov and V. V. Organov) describes a device for improving condensation of water vapor in a surface condenser wherein multiple pointed, elongated electrodes are attached to a lattice-work in an hexagonal arrangement, and the lattice work is installed parallel to the upper surfaces of the tube bundle inside the condenser. The spacing between the electrodes and the distance from the electrode tips to the condenser tubing have a certain proportion. When a voltage is applied to the electrodes which is high enough to cause current of the proper magnitude to flow from the electrodes to the condenser tubing, a corona discharge is produced at the tips of the electrodes, and the ions in the discharge nucleate water droplets, whereby condensation of water vapor is improved.

The device described in USSR Authors' Certificate 1,677,483 A1 was operated only in a laboratory test chamber. The tips of the electrodes are near to the tube bundle, and the corona discharge from each electrode is limited to a relatively small cone-shaped volume between the tip of the electrode and the tube bundle. Because the corona discharges are limited to small volumes immediately adjacent to the tube bundle, this device has no effect upon turbulence and flow instabilities which may exist in the turbine neck above the condenser. Water droplets are nucleated only within a relatively small volume, and exist only a very short time before they impinge on the tube surfaces. The breakdown electric field strength of the flowing wet steam varies with moisture content, flow velocity, and other parameters. Therefore, applying the same voltage to all electrodes may induce currents of widely different magnitudes through the various electrodes. Sparks or arc discharges may form at some electrodes, drawing power away from the other electrodes and making the device inoperable. Because a corona discharge is maintained at each electrode, the high voltage power required is fairly large in relation to the volume of the corona discharge and the beneficial effect produced.

Russian Patent Appl. 5047816/06 (filed by A. O. Tarelin, Yu. I. Serhienko, V. P. Skliarov and A. E. Khinevych) describes an improved implementation of the same idea, wherein somewhat larger pointed, elongated electrodes are arranged in rows above the tube bundle. Each row of electrodes is attached to a metal pipe which is electrically isolated from the rest of the condenser, and charged with 50 Hz pulsed DC power at high voltage (produced by half-wave rectification of AC power with no filtering). Each electrode is electrically isolated from the pipe by a piece of insulating plastic separating the juxtaposed metal parts. The combination of metal-plastic-metal forms a capacitor. The AC component of the pulsed power passes through the formed capacitor to the electrode. The capacitor acts as a ballast for the electrode, limiting the current to the electrode while dissipating little power. When a large enough voltage is applied to the electrodes, each electrode carries sufficient current to produce a corona discharge, but the impedance of the formed capacitor prevents an electrode from taking enough current to produce a spark or arc. However, the other drawbacks described above remain. In laboratory tests of this device the heat transfer coefficient of the outermost tubes in the bundle increased by a factor of 1.2 to 1.5, but tubes inside the bundle were not effected; therefore, the overall effect upon heat transfer in the tube bundle was small. This device was never successfully operated in a powerplant because, due to leakage currents on the surface of the plastic insulator, adequate electrical isolation of the different components could not be achieved.

Yabe (1995) recently reviewed electrostatic phenomena and techniques applicable to problems of heat transfer. The literature reviewed by Yabe contains no prior art related to the invention provided herein. All examples described by Yabe relate to heat transfer processes involving chlorofluorocarbons and other organic liquids of very small electric conductivity and large breakdown electric field strength. Specific examples include using a corona wind to move vapor through a heat exchanger at flow velocities up to 2 m/s, using electrostriction to produce jets of liquid, and using electric fields to remove condensate from a heat exchange surface. Electric field strength required to produce the desired effects, where quoted, was always 10 kV/cm or greater, much larger than the electric field strength taught by us. In most cases, the heat exchange surface served as the counter electrode. In his review, Yabe made no mention at all of utilizing electric fields in a steam condenser, nor using electric fields to produce condensation nuclei or otherwise improve internal condensation.

OBJECTS AND ADVANTAGES

This invention is related to decreasing the pressure of the steam flowing out of the last stage of the turbine, through the turbine neck, and into the condenser. Turbulence and flow instabilities are also decreased, and the overall effect is increased power output at a constant fuel rate.

The gas phase of the wet steam flowing out of the turbine is supercooled and continues to condense on water drops present in the wet steam. Because these water drops are relatively large, the surface area available for condensation is small, and the internal condensation process does not reach equilibrium. Therefore, pressure within the turbine neck is larger than it would be if equilibrium were reached, and the power output of the turbine is decreased.

Charge separation processes inside the turbine produce a positive electric charge on water drops in the wet steam flowing out of the turbine. When exposed to an electric field with field strength above a certain threshhold value, charged liquid drops become unstable and disintegrate, producing many small droplets which can serve as nuclei for condensation.

Accordingly, our method for increasing power output involves:

(1) Producing within the flow path of the wet steam an electric field strong enough to break-up the charged water drops, and (2) Downstream of the strong electric field, providing space and time needed to allow water vapor to condense upon the droplets newly formed. In practice, the required time and space are provided by producing the electric field within the flow path at some distance from the heat exchange tubes, not immediately adjacent to the heat exchange tubes as taught in prior art.

Our device for increasing power includes:

(1) Several active electrodes suspended in one plane within the turbine neck some distance above the condenser tube bundles and perpendicular to the flow of wet steam, (2) Grounded electrodes suspended between the active electrodes, (3) A source of high voltage power for the active electrodes, and (4) insulators to support the active electrodes and feed high voltage power to them, which are capable of reliable operation in the physical environment that exists inside the turbine neck.

The alternating active and grounded electrodes create zones of high electric field strength extending across practically the entire cross-section of steam flow in the turbine neck. Most of the steam passes through the strong electric fields, and water drops within the steam disintegrate to form numerous nuclei for internal condensation. Improved internal condensation decreases the backpressure, increasing power output.

Because the wet steam contains charged water drops, the strong electric fields exert a force on the wet steam, directly causing flow variations and turbulence to decrease. This effect causes a further decrease on turbine backpressure.

The method and device provided herein are distinct over and superior to prior art for several reasons:

(1) In the prior art (USSR Authors' Certificate 1,677,483 A1; Russian Patent Appl. 5047816/06) pointed electrodes were installed at a small distance from the the tube bundle, and rather small conically shaped regions of high electric field strength were produced, immediately adjacent to the outer surface of the tube bundle. These small regions of high electric field strength did not cover the complete cross-section of the wet steam flow. Accordingly, only part of the steam flow was exposed to the strong electric fields.

(2) Because the regions of high electric field strength were immediately adjacent to the tube bundles, the nuclei formed therein had little or no time to grow by condensation before impinging on the tube bundle. The prior art references completely fail to note the desirability of locating the region of high electric field strength at some distance from the tube bundle.

(3) Because the regions of high electric field strength are small and immediately adjacent to the tube bundle, there is little effect upon the gas flow dynamics within the turbine neck, and no benefit from decreased turbulence and flow variations.

(4) In the prior art devices, practically the entire current flows from the active electrode to ground through the heat exchange tubing, which serves as the counter electrode by design; therefore, the heat exchange tubing might be corroded.

(5) The prior art devices were never operated successfully in a generating unit, and even in laboratory tests their beneficial effect upon condensation was small.

(6) The prior art relies on the corona discharge to nucleate water droplets, and makes no mention of the existence of charged water drops in the wet steam flow. Insofar as they are operable at all, the prior art devices do not require the presence of charged water drops in the steam for their operation.

The invention described herein was made possible by the surprising and unexpected discovery that the water drops in wet steam flowing out of a turbine carry a positive charge, which can readily be detected and measured using the procedure described in Example 1. The invention described herein requires the presence of charged water drops in the turbine exhaust.

In the method and device provided herein, counter electrodes are provided and disposed near to the active electrodes, and all of the electrodes are installed in the flow path of the wet steam at some distance away from the tube bundles. Therefore, (a) Substantially the entire cross-section of the turbine neck is covered with strong electric fields.

(b) The droplets formed have space and time to serve as nuclei for internal condensation before they reach the tube bundle.

(c) Gas flow dynamics are favorably affected.

(d) Because counter electrodes are provided, only a small fraction of the current from the active electrodes flows to ground through the heat exchange tubing.

(e) The method and device provided herein have been successfully operated in a power plant with good effect, and the heated insulators provided in the related U.S. patent application identified above and in Russian Patent No. 2,006,081 serve very well in this application.

DESCRIPTION OF THE INVENTION

While we believe the explanations given here to be true, we do not wish to be bound by them.

Description of the Invention—Definition of Terms

"Active electrodes" refers to electrodes that are maintained at a large electric potential relative to ground.

"Alternating electric field" refers to an electric field the direction of which periodically reverses in a sinusoidal manner with time. "Alternating potential" is similarly defined. "Apparent charge density" is charge density in the wet steam determined using the method described in Example 1.

"Applying a large voltage between at least one active electrode and at least one counter electrode" describes electrically connecting one pole of a source of high voltage power to the active electrodes, and the other pole to the counter electrodes. If the counter electrodes are grounded, the second pole can be connected to the electrical ground.

"Associated current" refers to the currents that flow through the wet steam from the active electrodes to the counter electrodes or to various electrically conductive members of the condenser or turbine neck as a consequence of the strong electric field present.

"Average electric field strength" refers to the potential difference between two adjacent electrodes divided by the distance between them.

"Backpressure" refers to the static pressure measured in the turbine neck a short distance away from the last stage of the turbine.

"Breakdown electric field strength" $E_{bd}$ refers to the value of electric field strength necessary to produce an electrical discharge; for example, a corona, a spark, or an arc.

"Cable corona electrodes" refers to linear corona electrodes wherein the supporting member is a cord, wire, string or cable or another similar flexible material. A cable corona electrode will normally be installed by attachment to suitable tie points at either end, with the cable corona electrode stretched between them.

"Carrier string" is a flexible supporting member for a corona electrode which may be a wire, a plastic filament, a woven fiberglass cord or another kind of string-like material.

"Condenser" may be a surface condenser with a large number of heat exchange tubes, a contact condenser where steam is condensed by direct contact with a spray of cooling water, or a shell-and-tube heat exchanger used to condense steam at pressure above atmospheric in a cogeneration facility.

"Condenser pressure" refers to the static pressure measured a short distance above the condenser tube bundles.

"Connecting channel" in the claims refers to the turbine neck or to another connecting member that conducts steam from the turbine to the condenser. In the claims, the volume inside a surface condenser above the tube bundles is considered to be part of the connecting channel. In a contact condenser, the flow path of the steam right up to its first contact with the cooling water is considered to be an extension of the connecting channel. If an imaginary plane is drawn intersecting the connecting channel such that the flow path of the turbine exhaust is approximately perpendicular to this plane, the intersection of this plane with the inner surface of the connecting channel will "define a section intersecting the flow path". Typically, the active electrodes and counter electrodes and the electric field produced by them will be disposed near to one such imaginary plane. The shape of the connecting channel may allow some part of it to serve as a grounded counter electrode. For example, in the generating unit described in Example 5, the turbine neck has an approximately rectangular cross-section near to the condenser, the cable corona electrodes are disposed parallel to the longer axis of the rectangle, and the flat walls of the turbine neck serve as grounded electrodes adjacent to the two outermost active electrodes.

A "corona electrode" includes electrically conductive members which provide sharp points or edges that favor the formation of a corona discharge and a current-voltage relationship similar to curve 29 in FIG. 5. Many different kinds of corona electrodes may be used; a few examples are described below. The corona electrode may include a supporting member which mechanically supports the conductive members attached to it, and may also serve as a conductor. In the preferred embodiment of the invention described in this application, the supporting member is a carrier string comprising either a bare wire or a fiberglass cord covered with silicone rubber. These electrodes are flexible, and they are installed by stretching them between two appropriate insulators or tie points. A particular corona electrode is depicted in FIG. 3, wherein a double wire spiral is wrapped around the carrier string. If a nonconductive carrier string is used, a continuous conductor must be attached to it; in this case, the double wire spiral serves that purpose. Many other designs are possible; for example, the wire may be decorated with spikes or barbs similar to barbed wire used in fences. A corona electrode may consist of a strip of metal with serrated edges, or a square tube with sharp edges; in this case, the supporting member constitutes the entire electrode. Rigid rod or tubing may also be used as the supporting member, or a totally different geometry may be employed; for example, a metal rod with a single sharp point, or a conductive lattice-work with metal spikes attached to it.

"Counter electrodes" are disposed near to the active electrodes in order to produce an electric field of desired geometry and strength between them. In the preferred embodiment the counter electrodes are grounded, but they need not be. For example, maintaining the counter electrodes at a positive potential relative to ground but substantially smaller than the positive potential of the active electrodes would provide the benefit of reduced frequency of drop impacts upon the counter electrodes and thereby smaller flow resistance. The counter electrodes may be specially designed for that service, or they may be appropriately disposed bracing struts already present within the turbine neck, or they may be additional electrically conductive members installed for that purpose (rods, tubes, wires, etc.). In the demonstration described in Example 5, five grounded cable-type corona electrodes served as counter-electrodes, and the walls of the turbine neck adjacent to the two outermost active electrodes served as additional counter-electrodes. In the prior art the tube bundle served as a counter electrode, but in the present claims use of the tube bundle is specifically excluded from the list of possible counter electrodes.

"Current to electrical ground" refers to the current that flows from the active electrodes through the steam and then to grounded counter electrodes or to grounded members of the condenser and tube bundle; for example, heat exchange tubes or structural braces. When it is stated in the claims that "less than one-half of said associated current flows to said electrical ground through said heat exchange tubes", "one-half" is in relation to total current that flows from the active electrodes through the steam. If the counter electrodes are not grounded but are connected to the active electrodes through a floating high voltage circuit, the stray currents that flow to ground through the heat exchange tubes and structural braces may, in fact, represent the entire current to ground.

"Direct electric field" is one that maintains constant polarity (aside from accidental or random fluctuations) and does not reverse periodically with time. It is a field produced by a source of direct high voltage power, or by a natural charging process that has constant polarity. "Direct potential" and "direct voltage" are similarly defined.

"Double wire spiral" is a wire coil of small radius wound around a cylindrical supporting member of larger radius as shown in FIG. 3.

"Electrical ground" refers to the large electrically continuous mass of metal that comprises most of a power generating unit (turbine housing, generator housing, condenser shell, structural members, tube bundles, etc.) and also to the electric potential of that mass of metal.

"In the flow path" refers to a position somewhere between the last stage of the turbine and the condenser tube bundle, but not right at the surface of the tube bundle. In the claims, physical separation between the electric field and the tube bundle is provided by specifying that the electric field is produced using at least one active electrode and at least one counter electrode which cannot be the tube bundle. An electric field produced using counter electrodes other than the tube bundle will convey less than one-half of its associated current to ground by way of the tube bundle.

Foreign Patent Document References or any other kind of high voltage insulator wherein insulating function is preserved in a humid environment by maintaining the insulating body at elevated temperature. Some such insulators are heated using power provided by an external power supply and require power supply leads; others are heated by leakage current to ground and therefore to not require power supply leads.

"Internal condensation" refers to condensation of water vapor that occurs at some distance away from a solid surface; for example, the formation of a water drop by condensation of water vapor upon a suitable nucleus within the flowing wet steam.

"Large electric potential" refers to a value or range of values typical of the active electrodes as a group. This value will be kilovolts to tens of kilovolts relative to electrical ground with either sign; for example, about +20 kV DC in the preferred embodiment provided herein. If powered by an external source of high voltage power, all of the active electrodes normally will have the same electric potential, but the device can be constructed to allow operation with active electrodes at different potentials. If the active electrodes are powered by the charged drops in the turbine exhaust, the exact value of the potential will usually be different for each electrode.

"Linear corona electrode" refers to a corona electrode wherein the supporting element is a rod, a strip, a linear extruded shape, a tube, a cord, a cable, a wire or another elongated member, whether flexible or rigid.

"Power output" refers to the useful work produced by the steam turbine. Normally power output will refer to electric power, but may also be mechanical power used as such; for example, in a naval propulsion system.

The "predetermined value" of the average electric field strength produced by providing a large electric potential to the active electrodes is chosen to provide optimal operation of the device and method, as determined by testing. The tests used to determine this value may be done during the design phase, during initial calibration of the device, or periodically or continuously while the device is in operation using manual or automated procedures.

"Saturation temperature" is the temperature at which water vapor at a given pressure is in equilibrium with liquid water. It is a function of pressure.

"Source of direct high voltage power" describes a power supply that operates in the kilovolt range. The power output preferably is filtered to produce a nearly flat waveform, but need not be; full-wave or half-wave rectified current can also be used to power the active electrodes.

Volatile bases added to the "steam supply" might be added to feed water, the condensate, the make-up water or to some other place in the water loop of the generating unit.

"Substantially coplanar" refers to a disposition of linear electrodes about an imaginary plane, whereby the distance perpendicular to the plane separating adjacent electrodes is smaller than the distance parallel to the place separating adjacent electrodes.

"Steam power generating unit" will normally be an electric generating unit, but may also be a unit that produces mechanical power for direct use; for example, a naval propulsion system or a steam turbine serving as a prime mover in industry.

"Substantially the entire cross-section" means providing an electric field that fills as much of the cross-section of the turbine neck as may conveniently be provided. The electric field in some parts of the cross-section may be weak or absent; for example, where suspension insulators provide an off-set between the wall of the turbine neck and the active electrodes.

"Turbine exhaust" in the claims refers to the wet steam that flows from the turbine, through the turbine neck, and into the condenser.

"Turbine neck" is the connecting element which joins the turbine to the condenser. The turbine neck generally has a curved tubular form, but other geometries are possible.

"Undesirable electrical discharges" would include sparks, arcs, or similar electrical discharges that would prevent stable operation of the device or short-out the high voltage applied to the active electrodes.

"Volatile bases" include ammonia, hydrazine, morpholine, other amines, and other compounds volatile at boiler temperature which render water alkaline and may be used as part of an "All Volatile Treatment" of the secondary water chemistry.

A=area of test probe exposed to steam flow
c=total concentration of electrolyte in the condensate
$d_{Rem}$=thickness of water removed when drops separate from the turbine blades
$d_s$=distance of the shear plane from the solid surface of the turbine blade
$E_{av}$=average electric field strength
$E_{bd}$=breakdown electric field strength
f=frequency of an alternating electric field
$f_{max}$=maximum frequency at which an alternating electric field will still have approximately the same effect as a direct electric field
$I_{Cnd}$=current to ground from a grounded electrode
$k_B$=1.38066×$10^{-16}$ erg $K^{-1}$=Boltzmann's Constant
$L_{TN}$=pressure loss within the turbine neck
$M_w$=18.015 g $mole^{-1}$ is the molecular weight of water
$N_O$=6.022×$10^{23}$ $mole^{-1}$=Avogadro's Number
P=pressure
$P_B$=turbine backpressure
$P_{CN}$=static pressure measured in the condenser just above the tube bundles
$P_{sat}(T)$=equilibrium saturation pressure of water at T
$P_{TE}$=static pressure measured in the turbine exhaust
Q=charge of a liquid drop
$R_c$=the radius of the critical nucleus; that is, a water droplet with $R_r > R_c$ will grow and function as a nucleus.
$R_r$=typical radius of drops coming out of the turbine
$R_n$=radius of droplet formed by fragmentation of charged drops
$S=P/P_{sat}(T)$=the saturation ratio
T=absolute temperature in degrees Kelvin
$T_{s.CN}$=saturation temperature (that is, wet bulb temperature) measured in the condenser just above the tube bundles
$T_{s.TE}$=saturation temperature (that is, wet bulb temperature) measured in the turbine exhaust near to the turbine
Δt=duration of the measurement
V=velocity of the steam flow
$v_f$=specific volume of liquid water
$v_g$=specific volume of water vapor
$x_f$=mass fraction of liquid water in wet steam
γ=surface tension of water $$\frac{1}{4\pi\epsilon_o} = 9\times10^9 \text{ newton m}^2\text{coul}^{-2} = 9\times10^{18} \text{ dyne cm}^2\text{coul}^{-2}$$

1/κ=thickness of the diffuse double layer; that is, the charge density of the double layer will decrease as exp(−κx) where x is the distance from the solid surface.
ρ=density of water
$\sigma_{DL}$=charge in diffuse double layer per unit surface area
Σ=average charge density in liquid phase
$\Sigma_{fg}$=average charge density in wet steam
$\tau_d$=time required for disintegration of the drop to begin in the electric field
$\tau_e$=time that the drop is exposed to the strong electric field

Description of the Invention—Principles of Operation

The process of internal condensation in the turbine exhaust requires appropriate nuclei; for example, droplets of liquid water. The turbine exhaust typically contains 10% liquid water by weight. Practically the entire liquid content of the turbine exhaust consists of relatively few large drops whose radius can exceed 0.001 cm. The large size of the drops is due to the mechanism that creates them. A drop is torn from the liquid film present on a turbine blade when the forces tearing the drop off (centrifugal force and impulse of the steam flow) exceed the force of surface tension holding the water drop on to the turbine blade. The relatively small number and limited surface area of the water drops leaving the turbine limits their effectiveness as nuclei for internal condensation.

Tests were conducted using the generating unit described in Example 5. The condensate contains 500 μg/L of ammonia and has room temperature pH=9.1. Using the method described in Example 1, it was determined that the wet steam in the turbine neck is positively charged with apparent charge density ≅$10^{-9}$ Coul/$cm^3$. Because dry steam does not acquire electric charge (Loeb, 1958), all of the charge in the wet steam is carried by the drops of liquid water.

Several mechanisms able to produce a static charge in liquid drops have been described in the literature (for example, Loeb 1958). In this case, the charge separation probably originates in the ionic equilibrium between the metal surface of the turbine blades and the condensate. The metal surface of the turbine blades is covered with a thin layer of metal oxide that has weakly acidic properties. The surface reacts with ammonia in the condensate, loses protons, and thereby acquires a negative surface charge. This negative charge is balanced by ammonium ions ($NH_4^+$) in the liquid immediately adjacent to the metal surface, forming a diffuse double layer. Due to the dilute nature of the condensate, the diffuse positive charge extends some distance into the liquid phase. When liquid drops are torn from the turbine blades, the outer portion of the diffuse double layer is torn awry with the drop. The drop thereby acquires a positive charge. In Example 3, equations representing this model of the charge separation process are presented and shown to predict a charge density in wet steam consistent with the values of apparent charge density determined in the powerplant.

In the absence of an external electric field, a water drop of radius $R_i$ carrying charge Q becomes unstable once the Raleigh criterion is satisfied (Grigoriev and Shiriaieva 1989; Taylor 1964):

$$W=\frac{Q^2}{64\pi^2\epsilon_o\gamma R_i^3}>1 \quad (2)$$

When W>1, electrostatic force exceeds the opposing force of surface tension, conical tips form at opposite poles of the drop, and jets of small droplets are ejected from the tips. An uncharged drop will disintegrate under the influence of an electric field when Taylor's criterion is satisfied (Taylor 1964):

$$Y=\frac{4\pi\epsilon_o E^2 R_i}{\gamma}>2.6 \quad (3)$$

To disintegrate an uncharged drop of 0.001 cm radius, E>126 kV/cm is required, much greater than the breakdown field strength of the wet steam; therefore, in practice only charged drops can be disintegrated by an imposed electric field.

Grigoriev and Shiriaieva (1989) presented a criterion of stability for a charged drop in an external electric field which may be written as:

$$-(W-1)^2+0.281YW+0.092Y+0.11Y^2>1 \quad (4)$$

If Y=0, inequality (4) reduces to inequality (2), and is W=0, inequality (4) reduces to inequality (3). If $R_1$=0.001 cm and W=0.99, the drop will become unstable at E>1.24 kV/cm, and many small droplets will be emitted as a jet from one end of the drop. The droplets produced typically are two orders of magnitude smaller than the parent drop, and may in their turn disintegrate into still smaller drops.

The time $\tau_d$ needed for a drop to elongate along the local electric field and begin disintegrating is (Grigoriev and Shiriaieva, 1989):

$$\tau_d\sim(\rho R_i^3/\gamma)^{0.5} \quad (5)$$

If $R_i$=0.001 cm, $\tau_d\sim4\cdot10^{-6}$s. The speed of the wet steam flow in the turbine neck near to the tube bundle is on the order of 40 m/sec, and the drop will travel 0.01 cm in 4 μs. Because the zone of large electric field strength will be about 10 cm in vertical extent, there is ample time available for disintegration to occur.

The relationship between the saturation ratio and the corresponding radius of the critical nucleus is given by:

$$\ln S=\ln\frac{P}{P_{sat}(T)}=\frac{2\gamma M}{N_o\rho k_B T R_c} \quad (6)$$

In Example 2, eqn. 6 is used to demonstrate that disintegration of charged water drops in an electric field will, in fact, produce nuclei with radius substantially larger than $R_c$, which will grow and enhance the internal condensation process. Therefore, breaking the few large drops leaving the turbine into many small droplets will have a large favorable effect upon the rate of internal condensation.

Description of the Invention of Invention—Design Considerations

A properly insulated electrode installed within the turbine neck can attain 10 kV or larger potential relative to ground by accumulating charge from the charged drops impinging on it. With proper placement of charged and grounded electrodes, this potential may suffice to disintegrate charged drops in the wet steam without requiring an external power supply. The average charge density and the velocity of the wet steam flow vary with operating conditions. Therefore, the electric potential that develops on an insulated electrode and its ability to disintegrate water drops in the wet steam will also change with operating conditions. For this reason, it is preferable to provide an external power supply capable of maintaining a set electrode potential greater than the "natural" potential that would be produced without an external power supply. It is preferred that the sign of the potential provided by the power supply to the active electrodes be the same as the sign of the potential naturally acquired from the charged water drops.

In order to disintegrate as many drops in the wet steam as possible, it is necessary to produce strong electric fields throughout substantially an entire cross section of the turbine neck. These fields are conveniently produced by installing active electrodes alternating with grounded electrodes and parallel with them in a plane that extends across the entire cross-section of the turbine neck. With a working voltage of 10–20 kV, providing 10–20 cm spacing between adjacent electrodes will give an average field strength of about 1 kV/cm.

The strong electric field should be located at some distance from the tube bundle, in order to allow time for the small droplets to serve as nuclei after they have been formed. It is also preferred that the electrodes used to create the electric field be installed far enough away from the tube bundle and other grounded members of the turbine neck and condenser to avoid a large distortion of the electric field between the electrodes by interaction with the surrounding grounded members.

Description of the Invention—The Role of Electrical Discharges

In the preferred embodiment, the electric fields are provided by cable-type corona electrodes. When the electric potential applied to the active electrodes is large enough to produce average electric field strength large enough to disintegrate charged water droplets between the electrodes, the electric field strength immediately adjacent to the electrodes will be several times larger, and an electrical discharge may be produced at the electrodes. This electrical discharge involves the disintegration of charged water droplets as described by Grigoriev and Shiriaieva (1989), and it may be beneficial but is not essential to the method.

If the potential applied to the active electrodes is large enough to produce $E>E_{bd}$ midway between the electrodes, another kind of discharge may be produced: sparks between the electrodes or an arc. Because an electric arc has negative resistance, the voltage across the arc will drop, current will increase, and most of the power output of the high voltage power supply will be consumed by its own internal resistance. As a result, the electric potential of the active electrodes will drop to a value too small to disintegrate charged water drops. If the high voltage power supply is insufficiently powerful to support the arc, the arc will quickly blow-out, and the device will begin to cycle rapidly: no discharge, corona discharge, sparks, arc, no discharge, corona discharge, and so on. In this condition the device will have little or no beneficial effect upon steam condensation.

Description of the Invention—Desired Operating Voltage and Electrode Spacing

The maximum voltage that can be applied to an electrode inside the turbine neck will be limited by leakage currents in the insulators that it is attached to. When heated insulators capable of operation at 100% humidity are used (as described in the related U.S. Patent Application identified above or in Russian Patent 2,006,081), a voltage of about 20 kV may be applied to an insulated wire placed inside the turbine neck 1.5–2 meters from the last stage of the turbine. Further increase of the voltage is limited by the conductivity of the wet steam even if insulators without leakage are used.

The voltage applied to the active electrodes must not cause sparks or arcs to form between the active electrodes and grounded electrodes or nearby grounded members of the turbine neck or condenser. In the generating unit used in our test work, the parameters of the turbine exhaust typically were 41° C., 59 mmHg, and 10% moisture, with flow velocity ≅40 m/s near to the condenser. The experimentally determined value of average electric field strength that will cause electrical breakdown under these conditions is $E_{bd}$≅2 kV/cm. With average electric field strength≅1.5 kV/cm breakdown does not occur.

The wet steam in the generating unit we used typically had apparent charge density≅$10^{-9}$ C $cm^{-3}$ and apparent charge density was not less than $2\times10^{-10}$ C $cm^{-3}$ under most operating conditions. The minimum average field strength required to break down water drops of 0.001 cm radius in wet steam with apparent charge density≅$2\times10^{-10}$ C $cm^{-3}$ at 41° C. is about 0.6 kV/cm; this value was experimentally determined to be the minimum average electric field strength needed to increase power output under these conditions. For these reasons, the electrode potential was adjusted to provide an average electric field strength of 1 kV/cm, which provided good method performance and a large margin of safety. Because the electrodes were spaced 20 cm apart, this average field strength was provided by applying 20 kV potential to the active electrodes.

It is not desirable to space the electrodes much less than 20 cm apart, because decreasing the spacing would increase the number of electrodes required, thereby increasing the cost of the installation and the resistance to steam flow in proportion. It is not desirable to space the electrodes much more than 20 cm apart, because the required electrode voltage would increase in proportion, and the safe operating limits of the insulators would soon be exceeded. Also, increasing electrode voltage beyond 20 kV would produce very intense electrical discharges near to the electrodes which might turn to sparks even at 1 kV/cm average field strength. Finally, the clearance needed between the active electrodes and grounded members of the turbine neck would need to be increased in proportion to electrode spacing, and it would become progressively more difficult to find a convenient place to install the electrodes within the turbine neck.

The breakdown electric field strength of the wet steam will decrease with decreasing pressure; for example, at 30 mmHg, $E_{bd}$≅1 kV/cm, and $E_{av}$≅0.8 kV/cm should give the desired results. Because the pressure may vary, the voltage applied to the electrodes may need to be carefully adjusted and readjusted. Sparking or arc formation is easily detected by observing the large fluctuations in electrode voltage and current that occur. In practice, it is often easiest to find the optimum electrode voltage by slowly increasing it until sparks begin to form, and then decreasing it by a few percent. This calibration procedure can be repeated periodically and automatically while the device is in operation.

The widest practical range of $E_{av}$ with conventional condensers will be about 250–3,000 V/cm, which spans acceptable values of $E_{av}$ corresponding to the entire range of condenser pressures encountered in practice. (However, the pressure in the condenser of a cogeneration plant will typically exceed one atmosphere, allowing operation at even higher values of $E_{av}$.) A narrower range of values 500–2,000 V/cm will encompass values appropriate to most steam power generating units. Frequently, a value within the narrower range 800–1,200 V/cm will prove suitable.

If the active electrodes derive their electric potential from the charged steam flow with no external power supply (FIG. 1), it may be desirable to space the electrodes less than 20cm apart. With smaller separation between the electrodes, the positive potential produced on the active electrodes will provide a larger electric field strength between the electrodes, sufficient to disintegrate charged water drops.

Finally, the smallest distance separating an active electrode from the tube bundle should be no less than the distance l between adjacent electrodes, and preferably not less than 1.5 l. In the preferred embodiment l=20 cm, the preferred distance is at least 30 cm, and 60 cm was actually used in the demonstration described in Example 5. Allowing adequate clearance will provide the time needed for the droplets to grow, eliminate the possibility of electrical breakdown between the active electrodes and the tube bundle, and minimize distortion of the electric field between the electrodes due to electrostatic interactions with the tube bundle. In this case, the fraction of current going to ground through the heat exchange tubing will be much less than one-half. The same minimum and preferred clearances apply to other grounded members of the condenser and tube bundle, excluding grounded members that are properly disposed and selected to serve as counter electrodes.

Description of the Invention—Desired Electrode Characteristics

To avoid sparking or arcing between adjacent electrodes, it is necessary to use electrodes for which the breakdown voltage exceeds the minimum voltage for corona discharge by as much as possible. In order to provide this margin of safety, the electrodes should be designed so that the slope of current vs. voltage is as small as possible to provide proper function of the electrodes over a wide range of voltage. In this case, variations in the distance between the electrodes will not cause large variations in discharge current along the length of the electrodes. The desired current-voltage relation is conveniently provided using a cable corona electrode wherein the supporting cord or wire has attached to it a double wire spiral which provides many sharp edges that concentrate the electric field strength, producing a corona discharge at a voltage much less than required to produce sparks or arcing (FIG. 5, curve 29).

A smooth electrode would inevitably have water drops clinging to it. The water drops would concentrate the electric field strength, favoring localized electrical discharges. Because of their initiation in drops of water, the discharges thus produced would be very uneven and unstable, decreasing the beneficial effect upon condensation, and favoring electrical breakdown in the form of sparks or arcs. A properly chosen corona electrode will not experience this problem, because the many sharp edges and points available to initiate corona discharge will far overwhelm the effect of the randomly distributed water drops of relatively large size.

An electrode placed in the turbine neck of a steam turbine is exposed to a turbulent steam-and-water flow carrying a large quantity of charged water drops and numerous abrasive particles. These particles consist mainly of iron oxides: $Fe_2O_3$, $Fe_2O_4$ and others, as well as metal particles broken away from the working surfaces of turbine and turbine neck as the result of erosion. The wet steam flow in the turbine neck pulsates with frequencies in the hertz to kilohertz range, and the electrodes are subjected to vibrations in this frequency range. The design of the electrodes must be chosen to provide useful service life in the physical environment that exists in the turbine neck, including impingement by charged drops and solid particles, and pulsating, turbulent flow with a wide frequency spectrum. As described below, the double wire spiral wound electrode depicted in FIG. 3 satisfies these requirements.

Description of the Invention—Effect Upon the Motion of Liquid Drops

Because the wet steam exiting the turbine carries an electric charge, electrodes placed within the turbine neck can have a large effect upon the flow dynamics within the turbine neck. The drops of water in the wet steam are most strongly affected, because they carry the electric charge.

The positively charged drops in the flow will be repelled from a positively charged electrode, and attracted to a grounded electrode. Given the same initial trajectory, a drop with a large charge-to-mass ratio will be deflected more than a drop with a small charge-to-mass ratio. In this way, the charged drops are segregated by size and charge. The drops that are repelled the least and pass closest to the positively charged electrode will be those that have the smallest charge-to-mass ratio; these drops will be exposed to the relatively strong electric field close to the electrode, favoring their disintegration. In this way, changes in the trajectory of the drops will tend to off-set the effect of different charge-to-mass ratios.

The experiment described in Example 4 demonstrated the strong effect of the electric field of an insulated electrode upon the trajectories of water drops.

Description of the Invention—Effect on Fluid Flow Dynamics

The motion of the vapor phase is coupled to the motion of the drops by friction, and the electrical effect upon the motion of the drops also has a strong effect upon the motion of the vapor. During the full-scale demonstration of the invention described in Example 5, it was noted that the magnitude of fluctuations in the dynamic pressure near to the tube bundles decreased by a factor greater than two, indicating a decrease in the turbulent motion of the flow.

The electrodes included in the preferred embodiment of the device formed a parallel array covering substantially an entire cross-section of the turbine neck. The parallel electrodes served as a comb that straightened out: the turbulent eddies in the flow passing between the electrodes. A parcel of the positively charged fluid moving toward a positively charged electrode with a horizontal component in its velocity will be deflected toward a more perfectly vertical trajectory allowing it to stay farther away from the positively charged electrode. This effect takes energy from horizontal motions of the fluid, which are associated with turbulent eddies, and transfers it to the steady flow parallel to the axis of the turbine neck. The size of this effect was demonstrated in the experiment described in Example 5.

Decreased turbulence in the steam flow causes $L_{TN}$ and $P_B$ to decrease, further increasing the efficiency of energy conversion.

Description of the Invention—Direct Potential Versus Alternating Potential

In the preferred embodiment of the invention, a large direct potential is applied to the active electrodes. Up to a certain frequency, an alternating potential has a similar effect upon wet steam flowing between the electrodes. If the separation between adjacent linear electrodes is l, the vertical extent of the region of large electric field strength is approximately 0.5 l. Wet steam flowing between the electrodes is exposed to the strong electric field for time interval $$\tau_e=0.5\ l/V \tag{7}$$

If the frequency of the applied potential satisfies the inequality $$f<2V/l=1/\tau_e \tag{8}$$

the wet steam will be exposed to the strong electric field for less than one period of oscillation of the potential; therefore, a parcel of wet steam passing between the electrodes will experience a potential that appears to be direct rather than alternating.

The flow velocity in the turbine neck cannot exceed the speed of sound in steam, which is about 430 m/s, and l≅0.2 m; therefore, $$f<f_{max}=2V/l=4{,}300\ s^{-1}=4.3\ \text{kHz} \tag{9}$$

If this frequency is exceeded, a large space charge will be present between the electrodes, favoring the formation of undesirable electrical discharges which would render the method inoperable (Loeb 1965, pp. 569–571). A limiting frequency of 5 kHz is used in the claims, to allow for slightly smaller electrode spacing. The maximum permissible frequency will be smaller at smaller flow velocity. In the experiment described in Example 5, steam flow velocity at the electrodes was about 58 m/s; in this case, $f_{max}$=580 Hz; intermediate coverage is claimed up to 1 kHz to allow for closer electrode spacing. In practice, AC power at the line frequency of approximately 50 Hz or 60 Hz is easiest to provide.

While an alternating potential may be used up to a certain frequency, a direct potential is preferred because a direct potential will expose the entire steam flow to the same electrical conditions, and will not produce oscillations in the steam flow or in the electrodes which might be induced by an alternating potential.

Description of the Invention—the Effect of Operating Conditions

Because the method involves disintegration of charged water drops, charged water drops must be present in the steam exiting the turbine. Under normal operating conditions, the turbine exhaust in a steam power generating unit which is not a cogeneration unit will contain 5–10 wt% of liquid water. Due to the effect of centrifugal force, extraction of steam will tend to remove a disproportionate amount of moisture from the turbine exhaust, and in extreme cases the steam remaining in the turbine exhaust may become practically dry, rendering the method inoperable (Example 7 below).

The main effect of steam pressure is related to the breakdown electric field strength of the wet steam $E_{bd}$. The breakdown electric field strength of the wet steam decreases very roughly in proportion to the pressure; therefore, the maximum voltage that can be applied to the active electrodes will be smaller at lower pressure, and the maximum attainable beneficial effect of the method may be limited under conditions of very low backpressure; for example, reduced load operation in wintertime. This limit is not likely to be encountered at full load, nor under partial load in warm weather.

The effect of unit load on the method is small; it is mediated by the effect of unit load upon backpressure.

Description of the Invention—the Effect of Water Chemistry

Because the electric charge of the water drops is derived from the streaming potential created when a liquid film of condensate flows over the surfaces of the turbine blades and separates from the edges of the blades, the chemical composition of the condensate is an important parameter. When the feed water chemistry of the generating unit includes ammonia or a volatile amine, the concentration of hydroxide ion in the condensate will be relatively large, metal surfaces inside the turbine will bear a substantial negative charge, and the water drops in the wet steam will readily acquire a positive charge from the diffuse double layer. Using reasonable values for the important parameters, the simple model outlined in Example 3, Case 1 predicts the correct value of average charge in the wet steam in the generating unit that was used in our tests.

If, on the other hand, the generating unit is running on sodium phosphate chemistry and no volatile base is present in the system and carry-over of NaOH and salts is small, the condensate will be practically pure water, and the electric double layer formed will be determined by trace impurities and the intrinsic acidity or alkalinity of the metal surface. In Example 3, Case 2, it is demonstrated that a charge of the same size can be imparted to the water drops even in this case. The water drops may acquire a positive charge or a negative charge, according to whether the metal surface releases protons or takes protons from the condensate. While the surface charge of metal will be small in the absence of volatile bases in the condensate, the diffuse double layer thickness $1/\kappa$ will be large, and a much larger fraction of the diffuse double layer will be sheared-off and will contribute to the charge of water drops in the turbine exhaust. However, the charge of the water drops can be much smaller if the condensate pH happens to match the isoelectric point of the metal surfaces inside the turbine in which case the surface charge on the metal will be practically nonexistent. In practical terms, sufficient charge density to make the method operable may-or-may-not be produced in this case, and the charge may be negative rather than positive.

In either case, ammonia or volatile amines may be added to the feed water or their concentration adjusted to provide a reliable positive charge density and maximize the beneficial effect of the method.

Electrostatic forces affect the separation of water drops from the turbine blades, favoring production of drops with $W \cong 1$. Larger drops would be unstable, while smaller drops would have larger surface energy in relation to their size. In this way, $R_1$ is automatically adjusted to compensate for variations in $\Sigma_\rho$ and $W \cong 1$ results.

DESCRIPTION OF THE INVENTION—DRAWING FIGURES

Figure 5:
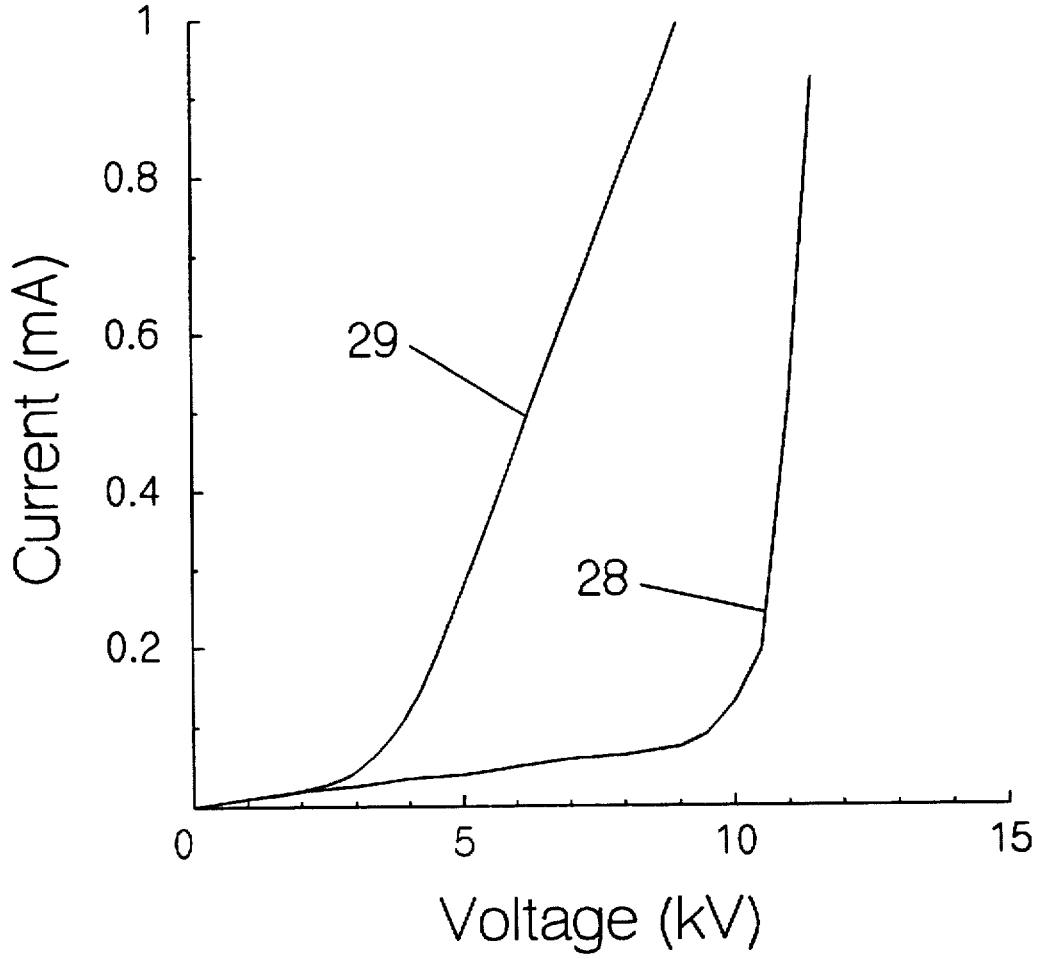

FIG. 5 compares the voltage-current characteristics of a plain cylindrical electrode with a cylindrical electrode wound with a double wire spiral.

Figure 6:
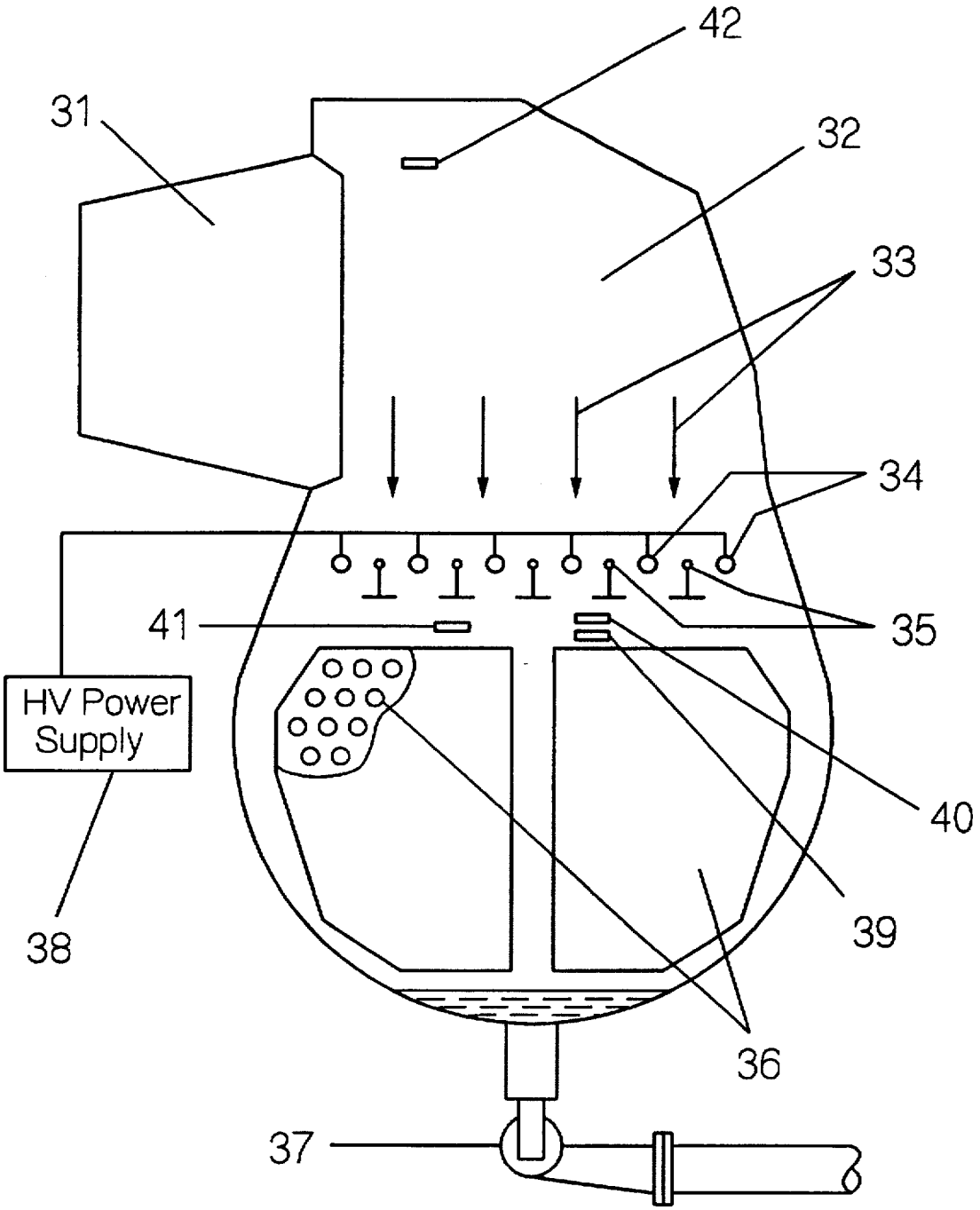

FIG. 6 illustrates the installation of the device used to demonstrate the method as described in Example 5.

Figure 7:
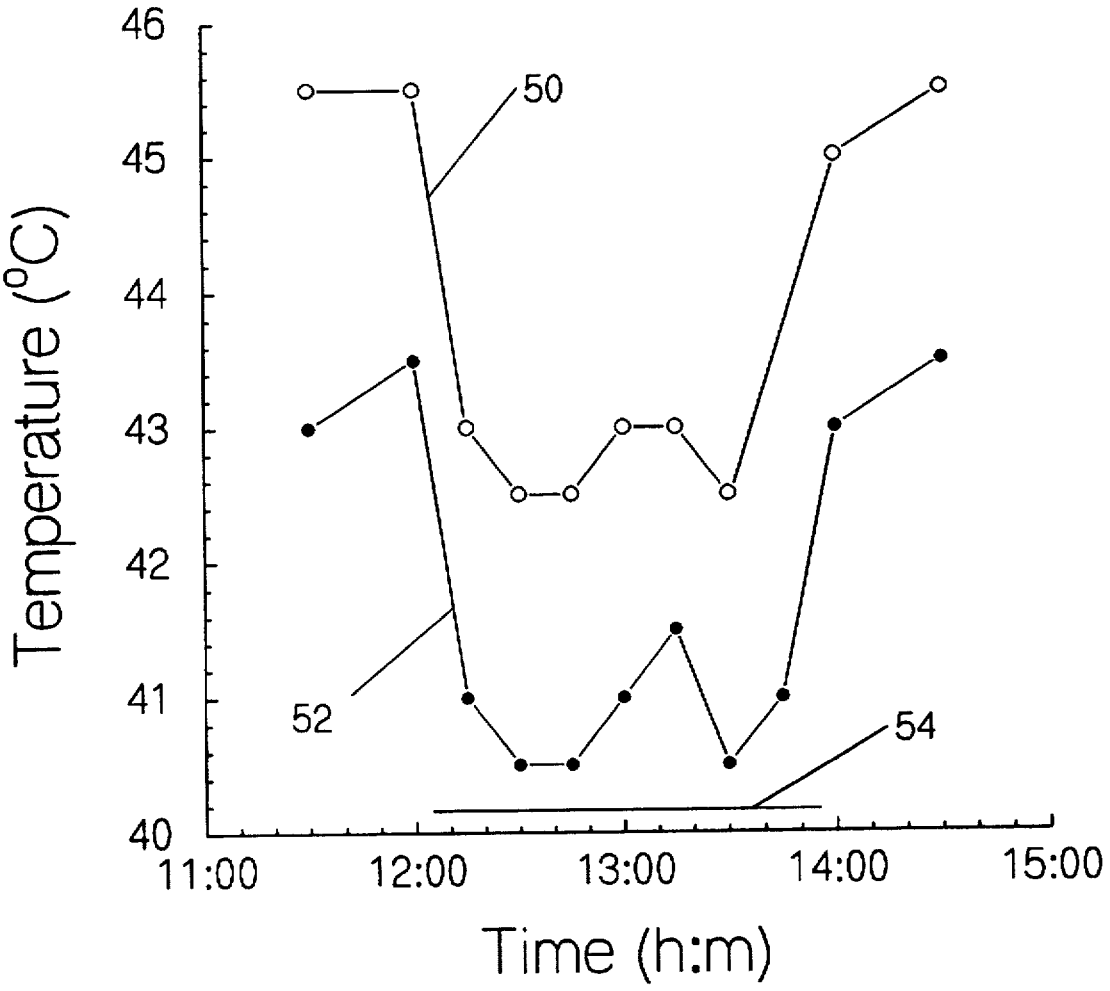

FIG. 7 illustrates the effect upon saturation temperature of applying a large direct potential to the active electrodes.

Figure 8:
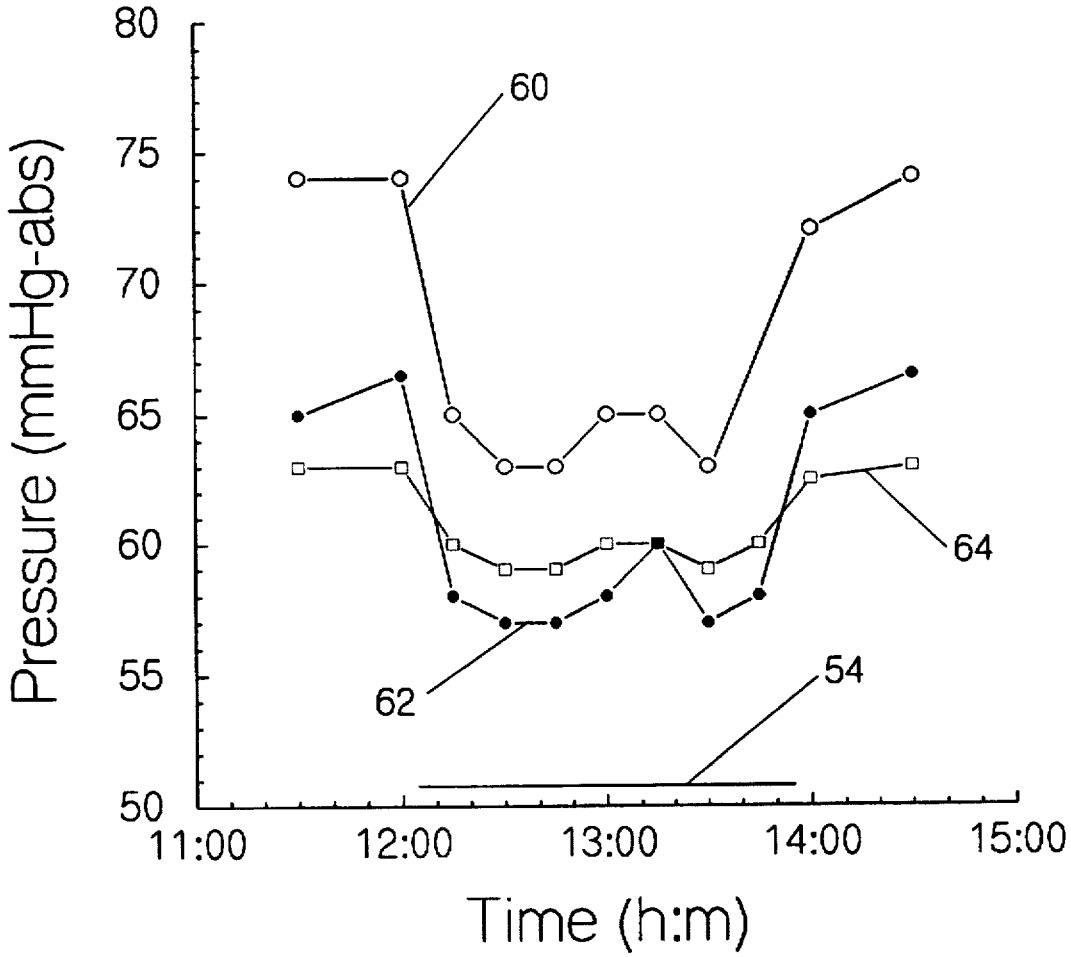

FIG. 8 illustrates the effect upon pressure of applying a large direct potential to the active electrodes.

Figure 9:
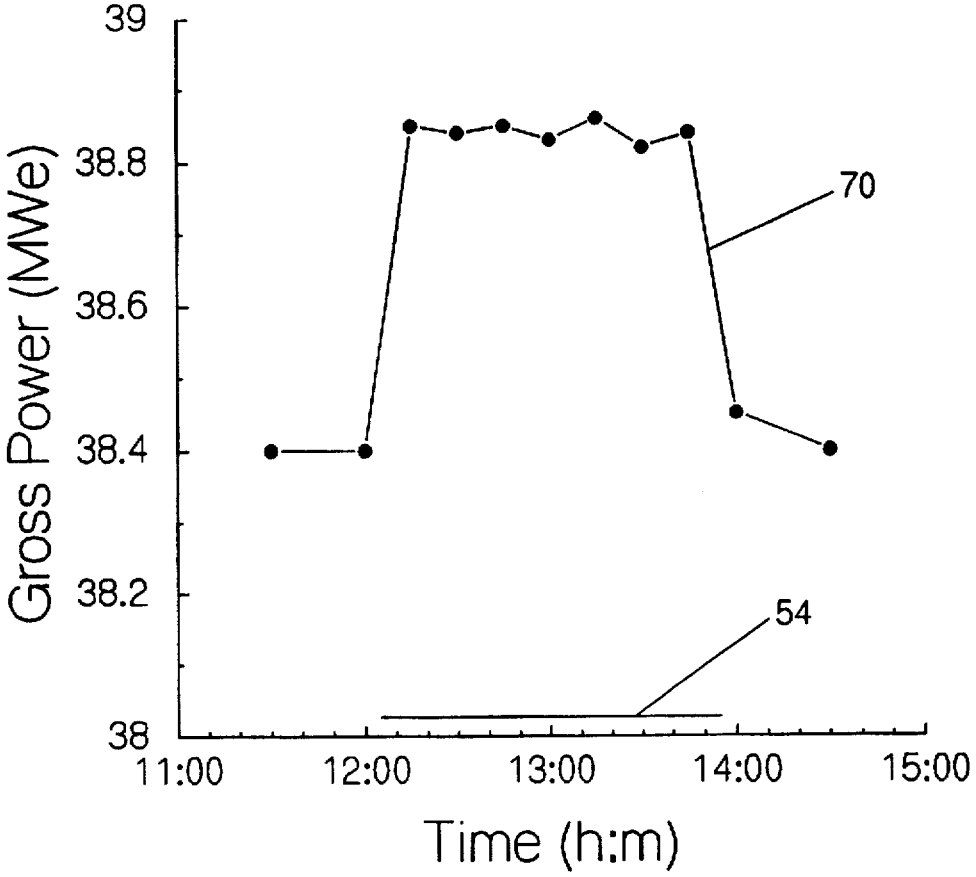

FIG. 9 illustrates the effect upon gross power output of applying a large direct potential to the active electrodes.

DESCRIPTION OF THE INVENTION—LIST OF REFERENCE NUMERALS

FIG. 1:

3 heated suspension insulators
32 turbine neck (shown in cross-section)
33 direction of wet steam flow
34 active electrodes
35 grounded electrodes

FIG. 2:

3 heated suspension insulators
7 heated pass-through insulators
32 turbine neck (shown in cross-section)
33 direction of wet steam flow
34 active electrodes
35 grounded electrodes
38 high voltage power supply

FIG. 3:

21 carrier string
22 double wire spiral
23 binding wire

FIG. 4:

24 fiberglass cord
25 silicone rubber casing

FIG. 5:

28 relationship of current to voltage for a smooth cylindrical electrode
29 relationship of current to voltage for a corona electrode that includes a double wire spiral

FIG. 6:

31 exhaust part of turbine
32 turbine neck
33 direction of wet steam flow
34 active electrodes
35 grounded electrodes
36 condenser tube bundles
37 condensate pump
38 high voltage power supply
39 static pressure probe
40 dynamic pressure probe 41 temperature probe ($T_{s,CN}$)
42 temperature probe ($T_{s,TE}$)

FIG. 7:

50 saturation temperature near turbine exhaust ($T_{s,TE}$)
52 saturation temperature above condenser tube bundle ($T_{s,CN}$)
54 time interval during which high voltage power was on

FIG. 8:

54 time interval during which high voltage power was on
60 pressure in turbine exhaust ($P_{TE,T}$)
62 pressure above condenser tube bundle ($P_{CN,T}$)
64 pressure above condenser tube bundle determined using Hg-manometer ($P_{CN,m}$)

FIG. 9:

54 time interval during which high voltage power was on
70 gross power output

DESCRIPTION OF THE INVENTION—PREFERRED EMBODIMENTS

Figure 1:
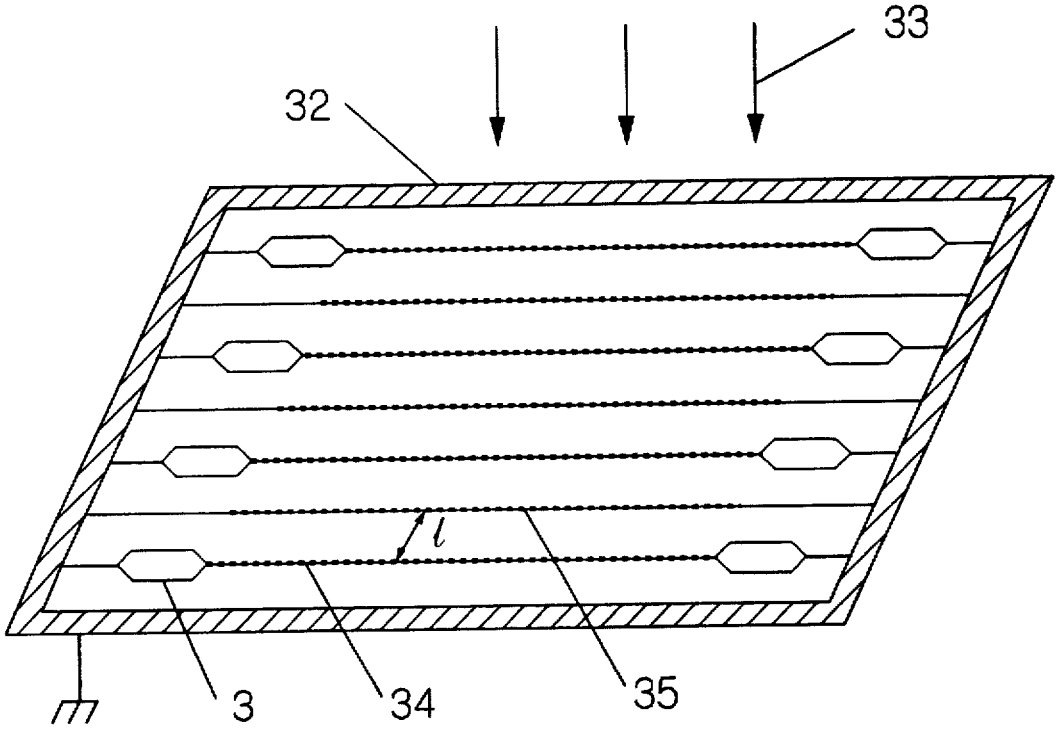
FIG. 1 illustrates a device comprising electrodes and insulators for improving steam condensation powered by the electric charge in the wet steam without need for an external power supply.

FIG. 1 illustrates a passive device of electrodes and insulators for improving steam condensation powered by the electric charge in the wet steam without need for an external high voltage power supply. Heated suspension insulators 3 are installed within the turbine neck 32 (shown in cross-section) with active electrodes 34 suspended between them. Grounded electrodes 35 are located between active electrodes 34, and are attached to suitable grounded tie-points at either end. Active electrodes 34 and grounded electrodes 35 lie in a parallel arrangement approximately in one plane, equally spaced with separation l between adjacent electrodes. The array of electrodes fills substantially the entire cross-section of turbine neck 32, and most of wet steam flow 33 passes between the electrodes. Heated insulators 3 may be powered by an external power supply or by high voltage leakage current, in which case an external power supply is not required. Both active electrodes 34 and grounded electrodes 35 are preferably cable corona electrodes.

Figure 2:
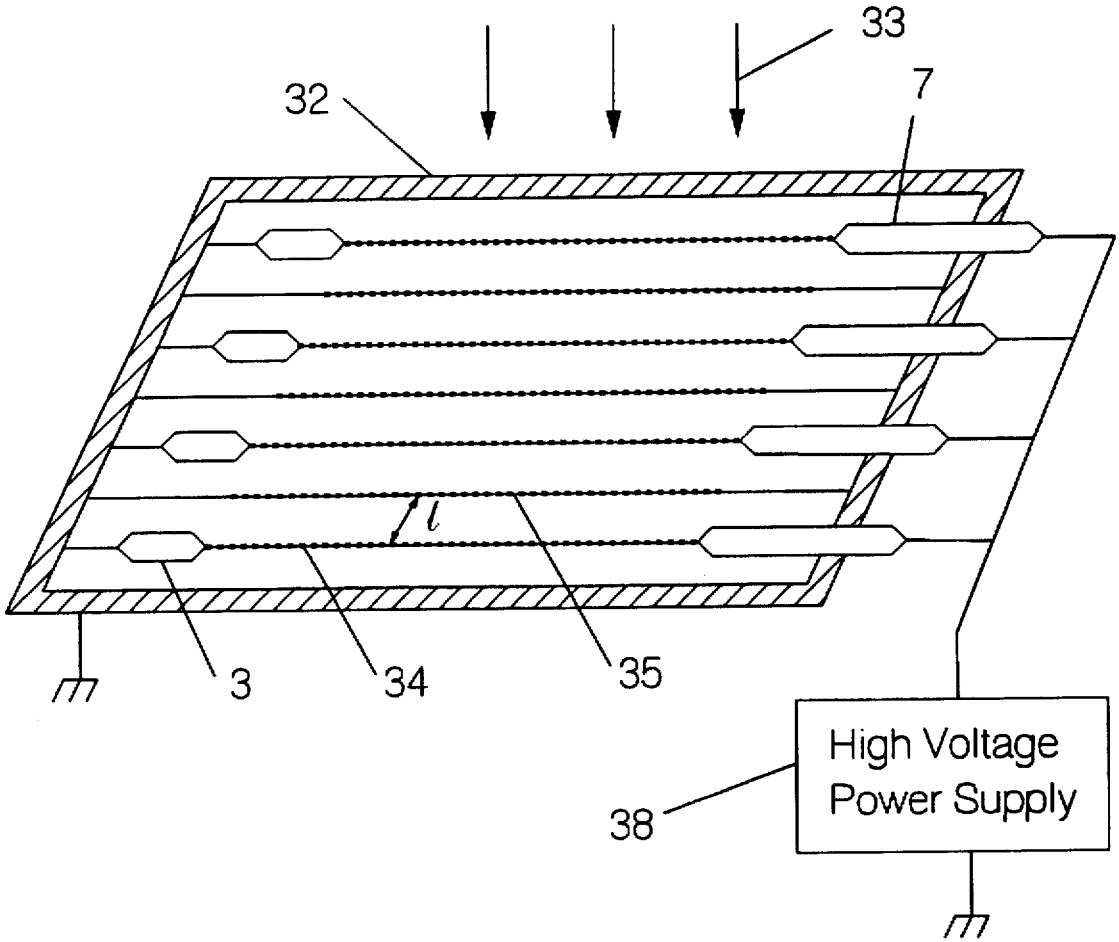
FIG. 2 illustrates a device comprising electrodes and insulators for improving steam condensation further provided with an external power supply.

FIG. 2 illustrates an active device of electrodes and insulators for improving steam condensation powered by external high voltage power supply 38. In the preferred embodiment the counter electrodes are grounded, but counter electrodes electrically isolated from ground and held at a potential different from ground may also be used. One end of each active electrode 34 is attached to heated suspension insulator 3, and the other end is attached to heated pass-through insulator 7, which provides an electrical connection with high voltage power supply 38. The other elements in FIG. 2 are the same as in FIG. 1. In the preferred embodiment the sign of the electric potential provided to the active electrodes is the same as the sign of the charge of the water drops.

The distance l between grounded electrodes 35 and active electrodes 34 is preferably about 20 cm, and the minimum distance separating active electrodes 34 from grounded members of the turbine neck or condenser should be at least 1.5 l.

Figure 3:
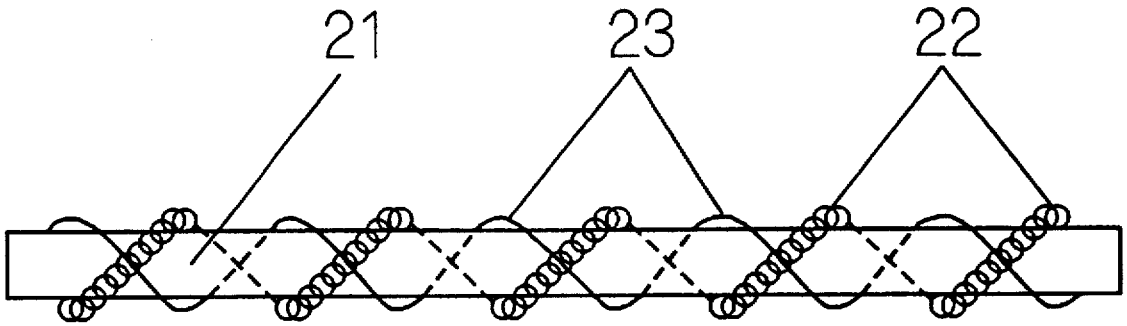
FIG. 3 illustrates the construction of a corona electrode wherein a double wire spiral is wound around a carrier string.

FIG. 3 shows the construction of an electrode consisting of carrier string 21, double wire spiral 22 and binding wire 23. Carrier string 21 provides mechanical support and can be made of corrosion-resistant steel or another metal with hardness not less than HB=145–200. The double wire spiral 22 is made of bare constantan wire or another work hardened wire of the material having hardness HB=145–200.

Binding wire 23 helps prevent sag and shift of double wire spiral 22. Binding wire 23 may be made of wire with composition similar to double wire spiral 22.

Figure 4:
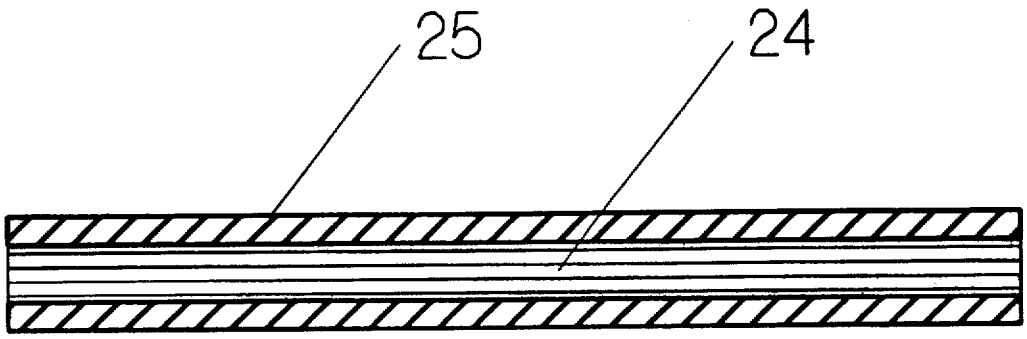
FIG. 4 shows the construction of a carrier string that may be included in the electrode in FIG. 3, comprising a fiberglass cord covered with silicone rubber.

The carrier string can also be made of fiberglass cord 24 molded in a silicon rubber shell 25 as illustrated in FIG. 4 A variety of other metallic wires or nonmetallic cords may be used to make the carrier string.

FIG. 5 compares the plots of current vs. voltage for electrode 28 comprising a bare metal rod with another electrode 29 comprising a steel rod wound with a double wire spiral as illustrated in FIG. 3. These data were obtained as described in Example 6.

FIG. 6 schematically illustrates the exhaust part of a steam turbine 31, turbine neck 32, and the condenser which includes tube bundles 36. This Figure represents the generating unit employed in the demonstration of the technology described in Example 5. Active electrodes 34 alternate with grounded electrodes 35. High voltage power supply 38 supplies power to active electrodes 34. Wet steam 33 passes between the alternating active electrodes 34 and grounded electrodes 35. Static pressure probe 39, saturation temperature probe 41, and dynamic pressure probe 40 record the corresponding parameters immediately above condenser tube bundles 36. Saturation temperature probe 42 records temperature in the turbine neck. Condensate pump 37 removes condensate from the condenser. FIGS. 7, 8 and 9 are described in connection with Example 5, below.

OPERATION OF THE INVENTION

The device shown in FIG. 1 operates as follows:

Charged drops in wet steam flow 33 impinge upon active electrodes 34, charging them to some voltage U relative to grounded electrodes 35. An electric field is produced in the gaps between active electrodes 34 and grounded electrodes 35. The average strength of said electric field is a function of the charge density of wet steam flow 33 and other parameters. If the average electric field strength exceeds 0.6 kV/cm, electrically charged water drops passing between the electrodes will disintegrate producing many small charged droplets. Each small droplet thus formed serves as a nucleus for internal condensation. High voltage heated suspension insulators 3 allow the maximum possible voltage to develop at active electrodes 34, maximizing effectiveness of the device.

It was observed that an electrically isolated electrode installed above the condenser tube bundles acquired a potential of 3–10 kV relative to ground, while and isolated electrode installed near to the turbine exhaust acquired a potential of 16 kV. In the latter case, the average field strength with 20 cm electrode spacing would be 0.8 kV/cm, sufficient to disintegrate charged water drops.

The device shown in FIG. 2 operates as follows:

High voltage power supply 28 imposes a large electrical potential upon active electrodes 34. The operating voltage will usually be greater than the voltage spontaneously developed in the passive device illustrated in FIG. 1. Operation of the device will be substantially independent of the operating regime of the generating unit, and also independent of charge density in the wet steam. The operating voltage must be large enough to cause disintegration of charged drops, but not so large as to exceed the breakdown electric field strength of the medium; a spark or arc type discharge must not be created. An average electric field strength of about 1 kV/cm is favorable to operation of the method at 59 mmHg pressure; the optimal electric field strength may be smaller at lower pressure.

Upon passing between the electrodes, the charged water drops in wet steam flow 33 decompose into many small charged droplets. Each small droplet formed by decomposition of a large drop serves as a nucleus for internal condensation.

The electrode illustrated in FIG. 3 can operate for an extended period of time in the environment of the turbine neck, withstanding impacts of abrasive particles and vibration. Owing to the fact that carrier string 21 is wound with double wire spiral 22, the natural oscillation frequency of the electrode decreases greatly, and the electrode does not respond to high frequency fluctuations in the steam flow. Double wire spiral 22 springs back when struck by hard particles, preventing breakage.

Using the silicone rubber coated fiberglass carrier string depicted in FIG. 4 provides a very flexible cable electrode which is easy to handle and install without kinking or binding.

Double wire spiral 22 produces a large electric field intensity surrounding the relatively large working surface area of the electrode. The relationship of current vs. voltage for an electrode of this kind determined under laboratory conditions is illustrated in FIG. 5 as curve 29, and compared with a smooth cylindrical electrode (curve 28). At the same time, the small diameter of the wire comprising double wire spiral 22 and its vibration in the wet steam flow prevent the adhesion of large water drops on to the electrode that might interfere with proper operation of the electrode.

OPERATION OF THE INVENTION—EXAMPLES

TABLE 1

Values of variables used in sample calculations.

| Variable | Units | Value |
|---|---|---|
| Values assumed for purposes of illustration: | | |
| c | mole $L^{-1}$ | $10^{-5}$ |
| $d_{Rem}$ | cm | $10^{-3}$ |
| $d_s$ | cm | $4 \times 10^{-5}$ |
| $R_i$ | cm | $10^{-3}$ |
| $R_n$ | cm | $5 \times 10^{-5}$ |
| S | — | 1.01 |
| T | K | 314.15 |
| T(°C.) | °C. | 41 |
| P | mmHg | $59 = 1.01\ P_{sat}(41°)$ |
| $X_f$ | — | 0.1 |
| $1/\kappa$ | cm | $10^{-5}$ |
| $\sigma$ | C $cm^{-2}$ | $+8 \times 10^{-6}$ |
| Properties of water and steam at 41° C. and 59 mmHg: | | |
| $V_f$ | $cm^3 g^{-1}$ | 1.0083 |
| $V_g$ | $cm^3 g^{-1}$ | $1.838 \times 10^4$ |
| $\gamma$ | erg $cm^{-2}$ | 66.7 |
| $\rho$ | g $cm^{-3}$ | 0.9918 |

EXAMPLE 1

The apparent charge density in the wet steam flow is measured by placing an electrical probe with area A exposed to the steam flow. Current flows from the probe to ground through an ammeter. The apparent charge density in the steam flow is given by $$\Sigma_{fg} = \frac{I_{Gnd}}{V \cdot A} \tag{10}$$

The measurements usually were made using one of active electrodes 34 as the probe. The values obtained in this way slightly overstate the actual charge density in the steam flow, because positively charged drops will be deflected toward the grounded electrode; however, the measurements are repeatable and useful.

The value of apparent charge density was measured in this way numerous times in the generating unit described in Example 5, with the frequent result $\Sigma_{fg} \cong 10^{-9}$ coul $cm^{-3}$. Further assuming $R_1$=0.001 cm, and putting these values into Eqn. (2), W=1.3 is obtained. Allowing for the uncertainty in measuring $\Sigma_{fg}$ and the approximate value assumed for $R_i$, this calculated value is not significantly different from 1.

EXAMPLE 2

A large drop coming out of the turbine can have a radius of 0.001 cm. Upon passing through a strong electric field, this drop might disintegrate into $10^4$ little droplets, with radius$\cong 5\times10^{-5}$ cm. Putting this value and other values from Table 1 into eqn. 6, we obtain ln S=0.002 which is the minimum value required for the droplets to grow and serve as nuclei. In fact, the minimum value of ln S probably exceeds 0.01, corresponding to $r_c \leqq 9.3\times10^{-6}$ cm. Thus, the droplets produced are at least five times larger than the critical nucleus, and will grow.

EXAMPLE 3

Case 1

If ammonium hydroxide is the only electrolyte present in the condensate at pH 9.1, total electrolyte concentration $c \cong 10^{-5}$M. According to the Debye-Huckel Theory, the thickness of the diffuse double layer will be $1/\kappa = 10^{-5}$ cm (Verwey and Overbeek 1948). In contact with the weakly alkaline condensate, the metal surface will acquire a small negative charge, and a positive charge of equal magnitude will be present in the diffuse double layer. If the density of ionizable hydroxyl groups on the surface of the metal is 10 $nm^{-2}$ and 5% of these hydroxyl groups are dissociated, the total positive charge in the diffuse double layer $\sigma_{DL} \cong +0.5$ e $nm^{-2} = +8\times10^{-6}$ C $cm^{-2}$.

The average charge density in the water drops leaving the turbine will be $$\Sigma_f = \frac{\sigma_{DL}\exp(-\kappa d_s)}{d_{Rem} - d_s} = +1.53 \times 10^{-4} C\ cm^{-3} \tag{11}$$

and the average charge density in the wet steam in the turbine exhaust will be $$\Sigma_{fg} = \frac{v_f \sigma_f}{v_g(1 - x_f)}\ \Sigma_f = +9.3 \times 10^{-10} C\ cm^{-3} \tag{12}$$

in agreement with the measured apparent charge density$\cong 10^{-9}$ C $cm^{-3}$.

Case 2

If no volatile bases are present in the condensate, the only electrolyte present will be dissociated water ($H^+OH^-$) at $c \cong 10^{-7}$M, pH$\cong$7, and $1/\kappa \cong 10^{-4}$ cm. A small surface charge may form on the surface of the turbine blades due to intrinsic acidity or alkalinity of the surface. For purposes of argument, we will assume that the surface is slightly basic, and positive surface charge of +0.015 e $nm^{-2}$ is produced, which is balanced by a diffuse double layer consisting of hydroxide ions. In this case $\sigma_{DL}=-2.4\times10^{-7}$ C cm$^{-2}$ $\Sigma_f=-1.67\times10^{-4}$ C cm$^{-3}$ $\Sigma_{fg}=-1.0\times10^{-9}$ C cm$^{-3}$ This calculation demonstrates that comparable charging of the water drops is possible in the absence of volatile bases.

EXAMPLE 4

The following experiment demonstrated that the electric field associated with insulated electrodes can have a large effect upon the trajectories of charged drops in the wet steam, and therefore upon the dynamics of the wet steam as a whole. Two insulated electrodes 4.7 m long were installed in one plane across the turbine neck. The electrodes were located 20 cm above a grounded lattice-work brace, with a separation of 80 cm between them. Electrode No. 1 was connected to ground through an ammeter. While the turbine was in operation, the current from Electrode No. 1 to ground was measured with Electrode No. 2 insulated from ground, and then with Electrode No. 2 connected to ground. Grounding Electrode No. 2 decreased the current from Electrode No. 1 by 20–30%, depending on the charge in the steam flow. When Electrode No. 2 was isolated from ground, it accumulated a positive electric charge from the charged drops in the steam flow, which caused the positively charged drops to be deflected from Electrode No. 2 and toward the grounded electrode No. 1. With Electrode No. 2 grounded, the charged drops impinged on both grounded electrodes equally, and the current through Electrode No. 1 was therefore smaller.

EXAMPLE 5

A full test of the device and method to improve condensation was conducted utilizing the device installed as depicted in FIGS. 2 and 6. The test was conducted at the DES-2 powerplant belonging to Kharkivenergo, an electric utility company affiliated with the Ukrainian Ministry of Energy. The generating unit used for the test included a 50 cycle single flow condensing turbine Model VK-50-2 made by the Leningrad Metallurgical Factory with nominal power rating 50 MW, and a three phase generator made by the "Elektrosyla" Plant. When the unit was overhauled, the turbine was modified to allow medium pressure steam to be extracted for space heating use in a nearby village. The unit included a Model 50-KTsS-3 condenser which contains two horizontal tubing bundles of the segmented type. The turbine neck does not include a diffuser. The nominal design and operating parameters of the turbine and condenser are summarized in Table 2.

TABLE 2

Nominal design parameters of turbine and condenser

| Parameter | Unit | Design Value |
|---|---|---|
| Turbine: | | |
| Power | MW | 50 |
| HP Steam - P | atm-abs | 90 |
| HP Steam - T | °C. | 500 |
| HP Steam - Flow | Mg/hr | 235 |
| Moisture in turbine exhaust | wt % | 10 |
| Feed water - T | °C. | 217 |
| Ammonia in feed water | μg/L | 500 |

TABLE 2-continued

Nominal design parameters of turbine and condenser

| Parameter | Unit | Design Value |
|---|---|---|
| Feed water heater extractions | each | 5 |
| Steam taps for space heating | each | 1 |
| Feed water heaters - LP | each | 3 |
| Feed water heaters - HP | each | 2 |
| Deaerator - P | atm-abs | 6 |
| Condenser: | | |
| Condenser pressure | mmHg | 28 |
| Heat exchange area | sq-meters | 3,000 |
| Horizontal tube bundles | each | 2 |
| Cooling water circuits | each | 2 |
| Circ. Water - Inlet T | °C. | 10 |
| Circ. Water - Outlet T | °C. | 33 |
| Circ. Water - Flow | Mg/hr | 8,000 |

The turbine has been rebuilt and modernized several times, but the condenser is a primitive unit unchanged since the plant was built in 1930. The condenser pressure has always exceeded the design value by a large margin.

The test was conducted in winter weather, with approximately 30% of the steam withdrawn at intermediate pressure for space heating use while the test was in progress.

The numerous parameters recorded during the test are presented in Table 3. Among these, the saturation temperatures $T_{s,TE}$ and $T_{s,CN}$ measured in the turbine neck and in the condenser just above the tube bundle, respectively, and gross power $L_G$ most directly demonstrated the beneficial effect of the method and device.

Most of the data were collected using the ordinary monitoring gauges of the generating unit; most of the values are therefore not very accurate, but they are precise. Pressures greater than atmospheric were measured using Bourdon tube gauges. The needle of the gauge vibrated over a fixed range, and the value midrange was recorded.

The gross power output $L_G$ was recorded from the unit's power meter of a design and precision comparable to those used in US powerplants.

Saturation temperatures $T_{s,TE}$ and $T_{s,CN}$ are the wet bulb temperatures recorded in the turbine neck near to the turbine exhaust (temperature probe 42 in FIG. 6), and above the tube bundle (temperature probe 41 in FIG. 6). These temperature values were used to calculate the corresponding static pressures $P_{TE}$ and $P_{CN,T}$. When rapidly flowing wet steam hits the temperature probe, part of its kinetic energy is recovered and static pressure increases, thereby also increasing saturation temperature. The thermowells and temperature probes used were designed to minimize the resulting positive error, and the values reported for $T_{s,TE}$ and $T_{s,CN}$ are considered reliable.

Pressure probe 39 was connected to a simple vertical mercury manometer and provided an independent reading of pressure above the tube bundle $P_{CN,m}$. Because of the crude instrument used and the possible presence of condensate in the connecting tube, $P_{CN,m}$ is less accurate than $P_{CN,T}$ and the latter should be considered the more accurate determination of static pressure above the tube bundle. However, $P_{CN,m}$ does provide independent confirmation of the effect of the method upon pressure above the tube bundles.

The dynamic pressure above the tube bundles $P_{dyn}$ was measured using a Pitot tube (pressure probe 40 in FIG. 6) connected to a water manometer.

The construction of the device for intensifying condensation used in this test corresponds to the device depicted in FIGS. 2 and 6. The device included six active electrodes 34 installed in alternation with five grounded electrodes 35. The electrodes were installed in one plane approximately 60 cm above the tube bundles; at this elevation above the tube bundles, the cross-section of the the turbine neck measured 2.4 m×4.7 m. The two walls of the turbine neck parallel to the electrodes served as grounded counter electrodes at either edge. In this manner, practically the entire cross-section of the turbine neck was covered with alternating grounded and active electrodes with a spacing of 20 cm between adjacent electrodes; the same distance separated the active electrodes at either edge from the adjacent wall of the turbine neck. Active electrodes 34 were attached at one end to heated suspension insulators 3, and attached at the other end to heated pass-through insulators 7 which provided high voltage power to active electrodes 34.

The construction of active electrodes 34 and grounded electrodes 35 was the same as illustrated in FIG. 3. Carrier string 21 consisted of a stainless steel wire 2 mm in diameter. Double wire spiral 22 and binding wire 23 were made of 0.2 mm diameter constantan wire.

Regulated high voltage power supply 38 provided filtered DC power at 10–20 kV. The electrical breakdown voltage in the turbine neck under the conditions of the experiment was about 2 kV/cm. The volumetric charge density of the wet steam flow was not less than $10^{-9}$ Coul $cm^3$. With this volumetric charge density, electric field intensity≅0.6 kV/cm will suffice to disintegrate most of the water drops present. With electrode spacing 20 cm and 20 kV applied to active electrodes 34, electric field intensity of 1 kV/cm was produced.

With all of the active electrodes operating, the power draw of the high voltage power supply never exceeded 500 W. During the test, the various parameters presented in Table 3 were measured twice with high voltage power off, then measured seven times with high voltage power on, and finally measured twice with high voltage power off. While high voltage power was turned-off, the active electrodes were grounded to eliminate the spontaneous charging effect, allowing the entire effect of the method to be observed.

The results of the test are presented in Table 3 and FIGS. 7, 8 and 9. Turning the high voltage power on decreased $T_{s,TE}$ and $T_{s,CN}$ by about 2.5° C., and the temperatures returned to their initial values when high voltage power was turned off (FIG. 7). The corresponding decreases in $P_{TE}$ and $P_{CN,T}$ were about 11 and 8 mmHg, respectively, while $P_{CN,m}$ decreased by 4 mmHg (FIG. 8). The average magnitude of fluctuations in the dynamic pressure (measured using a water manometer) decreased by over one-half, indicating decreased turbulence in the wet steam flow with the high voltage on (Table 3). In this experiment, gross power increased by 0.43 MW, or 1.1% (Table 3).

During the test the main steam parameters and regulating pressures were completely steady, indicating that the increased power output observed was, in fact, caused by the application of high voltage to the active electrodes.

EXAMPLE 6

The plots of current vs. voltage presented in FIG. 5 were determined in a laboratory test chamber. The electrodes were 0.5 cm stainless steel rods 17 cm long mounted in parallel 10 cm apart. The atmosphere was saturated water vapor at 35° C. The current was determined as a function of voltage for the bare rods, and then determined again with a double wire spiral added to each rod, as illustrated in FIG. 3. Without the double wire spiral current was very small up to 10 kV, and then increased very rapidly, indicating imminent electrical breakdown between the electrodes (curve 28). With the double wire spiral, a corona discharge was initiated at about 3 kV, and the current increased smoothly with increasing voltage (curve 29).

EXAMPLE 7

Other tests were performed in connection with the demonstration described in Example 5. The charge density in the turbine exhaust was determined with the steam extraction tap for space heating fully open, whereby nearly 50% of total steam flow including most of the liquid water in the steam was diverted from the turbine exhaust. The measured volumetric charge density in the turbine exhaust decreased by a factor of 10 to 50 as a result.

TABLE 3

Summary of Field Test in 50 MW Powerplant.

| Parameter | Sym. | Units | | | | | | | | | | | |
|---|---|---|---|---|---|---|---|---|---|---|---|---|---|
| Time | t | h:m | 11:30 | 12:00 | 12:15 | 12:30 | 12:45 | 13:00 | 13:15 | 13:30 | 13:45 | 14:00 | 14:30 |
| Barometric P | $P_{atm}$ | mmHg | 753 | 753 | 753 | 753 | 753 | 753 | 753 | 753 | 753 | 753 | 753 |
| HV Power is | | | Off | Off | On | On | On | On | On | On | On | Off | Off |
| Gross Power | $L_G$ | MWe | 38.40 | 38.40 | 38.85 | 38.84 | 38.85 | 38.83 | 38.86 | 38.82 | 38.84 | 38.45 | 38.40 |
| Frequency | f | Hz | 49.91 | 49.90 | 49.91 | 49.92 | 49.91 | 49.95 | 49.92 | 49.91 | 49.90 | 49.92 | 49.91 |
| Main steam: | | | | | | | | | | | | | |
| Flow rate | $Q_o$ | Mg/hr | 227.5 | 227.5 | 227.5 | 227.5 | 227.5 | 227.5 | 227.5 | 227.5 | 227.5 | 227.5 | 227.5 |
| P before stop valve | % | kg/cm² | 84 | 84 | 84 | 84 | 84 | 84 | 84 | 84 | 84 | 84 | 84 |
| Temperature | $T_o$ | °C. | 510 | 510 | 510 | 510 | 510 | 510 | 510 | 510 | 510 | 510 | 510 |
| P in control valve loops: | | | | | | | | | | | | | |
| Valve I | $P_{vI}$ | kg/cm² | 82.5 | 82.5 | 82.5 | 82.5 | 82.5 | 82.5 | 82.5 | 82.5 | 82.5 | 82.5 | 82.5 |
| Valve II | $P_{vII}$ | kg/cm² | 81 | 81.5 | 81 | 81 | 81 | 81 | 81 | 81 | 81 | 81 | 81 |
| Valve III | $P_{vIII}$ | kg/cm² | 81 | 81 | 81 | 81 | 81 | 81 | 81 | 81 | 81 | 81 | 81 |
| Valve IV | $P_{vIV}$ | kg/cm² | 80.5 | 80.5 | 80.5 | 80.5 | 80.5 | 80.5 | 80.5 | 80.5 | 80.5 | 80.5 | 80.5 |
| P regul. stage plenum | $P_{RS}$ | kg/cm² | 44 | 44 | 45 | 45 | 45 | 45 | 45 | 45 | 45 | 45 | 45 |
| P at extraction points | | | | | | | | | | | | | |
| 1st extr. point | $P_{tI}$ | kg/cm² | 26.3 | 26.5 | 26.7 | 26.7 | 26.7 | 26.7 | 26.7 | 26.7 | 26.7 | 26.7 | 26.7 |
| 2nd extr. point | $P_{tII}$ | kg/cm² | 13 | 13.4 | 13.4 | 13.2 | 13.1 | 13.1 | 13.4 | 13.3 | 13.4 | 13.2 | 13.1 |
| 3rd extr. point | $P_{tIII}$ | kg/cm² | 5.1 | 5.1 | 5.2 | 5.2 | 5.1 | 5.1 | 5.2 | 5.2 | 5.2 | 5.1 | 5.1 |

TABLE 3-continued

Summary of Field Test in 50 MW Powerplant.

| Parameter | Sym. | Units | | | | | | | | | | | |
|---|---|---|---|---|---|---|---|---|---|---|---|---|---|
| Regul. extr. point | $P_{rV}$ | kg/cm$^2$ | 1.47 | 1.47 | 1.46 | 1.48 | 1.49 | 1.49 | 1.49 | 1.49 | 1.49 | 1.48 | 1.48 |
| Time | t | h:m | 11:30 | 12:00 | 12:15 | 12:30 | 12:45 | 13:00 | 13:15 | 13:30 | 13:45 | 14:00 | 14:30 |
| HV Power is | | | Off | Off | On | On | On | On | On | On | On | Off | Off |
| Gross Power | $P_G$ | MWe | 38.40 | 38.40 | 38.85 | 38.84 | 38.85 | 38.83 | 38.86 | 38.82 | 38.84 | 38.45 | 38.40 |
| Turbine exhaust: | | | | | | | | | | | | | |
| Saturation T | $T_{s,TN}$ | °C. | 45.5 | 43.0 | 42.5 | 42.5 | 43.0 | 43.0 | 42.5 | 41.0 | 45.0 | 45.5 | |
| P (from $T_{s,TN}$) | $P_{TN}$ | mmHg | 74 | 74 | 65 | 63 | 63 | 65 | 65 | 63 | 58 | 72 | 74 |
| Above tube bundles: | | | | | | | | | | | | | |
| Saturation T | $T_{s,CN}$ | °C. | 43 | 43.5 | 41.0 | 40.5 | 40.5 | 41.0 | 41.5 | 40.5 | 41.0 | 43.0 | 43.5 |
| P (from $T_{s,CN}$) | $P_{CN,T}$ | mmHg | 65 | 66.5 | 58 | 57 | 57 | 58 | 60 | 57 | 58 | 65 | 66.5 |
| P (manometer) | $P_{CN,m}$ | mmHg | 63 | 63 | 60 | 59 | 59 | 60 | 60 | 59 | 60 | 62.5 | 63 |
| Dynamic P | $P_{dyn}$ | mmH$_2$O | 2 ± 7 | 2 ± 6 | 4 ± 3 | 4 ± 2 | 3 ± 3 | 3 ± 5 | 4 ± 2 | 4 ± 2 | 3 ± 5 | 2 ± 8 | 2 ± 10 |
| Cooling water: | | | | | | | | | | | | | |
| P in CW lines | $P_{CW}$ | kg/cm$^2$ | 0.48 | 0.48 | 0.48 | 0.48 | 0.48 | 0.48 | 0.48 | 0.48 | 0.48 | 0.48 | 0.48 |
| CW T at entrance | $T_{in}$ | °C. | 5 | 5 | 5 | 5 | 5 | 5 | 5 | 5 | 5 | 5 | 5 |
| CW T at exit;right | $T_{out,r}$ | °C. | 14 | 15 | 15 | 14.5 | 15 | 15 | 15 | 15 | 14.5 | 14 | 14 |
| CW T at exit;left | $T_{out,l}$ | °C. | 20 | 20 | 20.5 | 20.5 | 20.5 | 20.5 | 20.5 | 20.5 | 20.5 | 20.5 | 20 |
| Main Condensate: | | | | | | | | | | | | | |
| Flow rate | $Q_C$ | Mg/hr | 198 | 200 | 200 | 200 | 200 | 200 | 200 | 205 | 203 | 203 | 203 |
| Temperature | $T_C$ | °C. | 41.7 | 41.7 | 41.5 | 41.5 | 41.4 | 41.4 | 41.5 | 41.4 | 41.5 | 41.5 | 41.8 |

All pressure values reported in Table 3 are absolute.

CONCLUSIONS, RAMIFICATIONS AND SCOPE

A preferred embodiment of a method and device for improving the condensation and flow of steam in the turbine neck and condenser of a steam turbine has been provided, wherein a series of cable corona electrodes are strung across practically entire cross-section of the turbine neck, with the active electrodes alternating with grounded electrodes. The electrodes consist of a stainless steel wire with a double wire spiral of fine constantan wire wound around the steel wire. Electrodes decorated with a double wire spiral are preferred, because they produce a quiet corona discharge near to the electrodes with little risk of sparking or arcing between adjacent electrodes. Many other designs of corona electrodes are available; for example, ones that resemble barbed wire, or having a metallic fringe. Corona electrodes wherein the supporting element is a rigid rod or tube may also be used.

The basic requirement is to produce an electric field strong enough to disintegrate charged water drops across substantially the entire cross-section of the turbine neck, without producing arc or spark type discharges. Any design or arrangement of electrodes that meets these operational requirements will serve the process needs. In some cases, only the active electrodes or only the counter electrodes might be corona electrodes, not both; for example, properly disposed structural braces might serve as grounded counter electrodes.

In the preferred embodiment described herein, the electrodes are about 60 cm away from the condenser tube bundles; in fact, they may be installed practically anywhere within the turbine neck, as long as sufficient clearance from grounded members is provided to avoid formation of undesirable electrical discharges, and the distance from the tube bundle is large enough to provide time for the many small droplets formed to serve as nuclei of condensation. The exact location of the electrodes should be chosen to maximize the beneficial effect of the method.

In the preferred embodiment, the strong electric field is located about 60 cm from the condenser tube bundles, and the electric field strength is much smaller closer to the tube bundles. A different arrangement of the electrodes might produce a region of strong electric field spanning substantially the entire cross-section of the turbine neck at some distance from the tube bundles as required by the method, but also provide substantial field strength adjacent to the tube bundles. Provision of this additional region of strong electric field adjacent to the tube bundles would not be essential for operation of the method, and should be considered an additional element if so provided.

In the preferred embodiment, the water drops in the wet steam have a positive charge, the potential applied to the active electrodes is positive relative to ground, and the positively charged water drops are repelled from the active electrodes. Applying a potential to the active electrodes with the same sign as the charge of the water drops minimizes the current drawn from the high voltage power supply. The method also would be operable with the potential of the active electrodes opposite the charge of the water drops, or with an alternating potential.

Appropriate high voltage suspension insulators must be used to support the active electrodes, and high voltage pass-through insulators to feed high voltage power to them. In the preferred embodiment provided here and used in our test work, electrically heated insulators were used. The particular insulators used in Example 5 included a resistive heating element inside the insulating body and powered by an external power supply. Insulators powered by leakage current and described in Russian Patent Application 5047816/06, or other kinds of heated insulators may also be used. Other kinds of insulators might also serve; for example, insulators covered with a hydrophobic fluorocarbon plastic which prevents formation of a continuous film of moisture without the need for heat.

In some cases the method and device will be operable without providing an external source of high voltage power. Because water drops in the turbine exhaust carry a positive charge, they will impart a positive charge to electrodes suspended in the turbine neck and well-insulated from grounded members of the turbine neck and condenser. In some cases, the potential difference that develops between the insulated electrodes and adjacent grounded electrodes will be large enough to disintegrate water drops passing between the electrodes. If the process is to be powered by the electric charge present in the steam without an external power supply (FIG. 1), active electrodes located closer to the turbine would be better, because the electric charge of the steam is greater there.

While the method and device described are primarily intended to improve condensation and energy conversion efficiency in a steam power generating unit equipped with a surface condenser, the invention is also applicable to other types of generating units; for example, generating units with direct contact condensers, or cogeneration units wherein steam exits the turbine at relatively high pressure (typically 1–10 atm) and is condensed in a surface-type heat exchanger, producing steam at moderately lower pressure on the other side of the heat exchanger. The invention is also applicable to steam turbines other than in electric generating units; for example, naval propulsion systems.

While the preferred embodiment and demonstration of the invention described herein refer to installation of the electrodes inside an elongated turbine neck that connects the condenser to the turbine, utility of the invention is not limited to that particular physical configuration. Some power generating units may include a different sort of connecting channel between turbine and condenser. It is only necessary to install the electrodes somewhere between the turbine and the condenser tube bundles at a sufficient distance from the tube bundles to allow the droplets formed to grow and serve as nuclei, and with sufficient clearance from other grounded members to avoid undesirable electrical discharges.

A single set of electrodes covering one cross-section of the tube bundle is described in the preferred embodiment. In some cases it may be beneficial to provide two or more sets of electrodes.

Ensuring that the turbine exhaust contains electrically charged water drops is essential for operability of the method. There will be sufficient charged water drops present under ordinary operating conditions in many steam power generating units, and no special action will be required. In other cases, it may be necessary to modify operating conditions to provide sufficient charged water drops; for example, to limit the amount of steam withdrawn if the withdrawn steam is taking with it most of the moisture from the turbine exhaust.

If necessary, feed water chemistry may be modified to increase charging of water drops; for example, by adding or increasing the concentration of ammonia of volatile amines. Because the charging mechanism requires a surface charge upon the turbine blades in the last stages of the turbine, the magnitude of the surface charge might also be increased by selecting alloys or modifying the metal surfaces by sputtering or another suitable means to control the acid-base properties of the metal surface, thereby producing a larger surface charge.

We claim:

1. A method for reducing turbine backpressure in a steam power generating unit whereby power output of said steam power generating unit is significantly increased therefor, said steam power generating unit having a steam supply and including a steam turbine driven by said steam supply and having a turbine exhaust having a flow path and comprising wet steam, and a condenser having an electrical ground, and a connecting channel defining a section intersecting the flow path of the turbine exhaust which conveys said turbine exhaust from the steam turbine to the condenser, wherein said method comprises the steps of:

(i) producing inside of said connecting channel an electric field, wherein said electric field lies in the flow path of said turbine exhaust, and (ii) using the produced electric field to provide an average electric field strength within said connecting channel of a predetermined value within a range of values such that said predetermined value is sufficiently large to reduce turbine backpressure and hence increase power output but is small enough to avoid undesirable electrical discharges.

2. The method of claim 1, further characterized by electrically charged water drops in said turbine exhaust being deflected by said electric field, modifying the flow of the turbine exhaust and decreasing turbulence, and being fragmented producing a multitude of small droplets that serve as nuclei for internal condensation, whereby turbine backpressure is decreased and power output of said steam generating unit is increased.

3. The method of claim 1 wherein said electric field is direct.

4. The method of claim 3 including the precursor step of adding volatile bases to said steam supply whereby the water drops in said turbine exhaust more easily acquire a positive charge.

5. The method of claim 3 wherein said range of values of step (ii) is at least 250 volts per centimeter, but not greater than 3,000 volts per centimeter.

6. The method of claim 3 wherein said range of values of step (ii) is at least 500 volts per centimeter, but not greater than 2,000 volts per centimeter.

7. The method of claim 3 wherein said range of values of step (ii) is at least 800 volts per centimeter, but not greater than 1,200 volts per centimeter.

8. The method of claim 1 wherein said electric field is produced by applying a large voltage between at least one active electrode and at least one counter electrode, said counter electrode being chosen from the class consisting of electrodes provided for that purpose, electrically conductive members provided for that purpose, properly disposed structural braces within said connecting channel, and properly disposed walls of said connecting channel, whereby a large electric potential is imposed upon said active electrodes.

9. The method of claim 8, wherein said electric field fills substantially the entire cross-section of said connecting channel.

10. The method of claim 9, wherein said large voltage is direct, and the sign of the electric potential of said active electrodes is the same as the sign of the charge of the electrically charged water drops in the turbine exhaust.

11. The method of claim 9, wherein said active electrodes acquire their large electric potential from the charged water drops.

12. The method of claim 10, wherein the large voltage is provided to the electrodes by an external source of direct high voltage power.

13. The method of claim 10 wherein said counter electrodes are grounded electrodes.

14. A method for reducing turbine backpressure in a steam power generating unit whereby power output of said steam power generating unit is significantly increased therefor, said steam power generating unit having a steam supply and including a steam turbine
driven by said steam supply and
having a turbine exhaust having a flow path, and a condenser having an electrical ground, and a connecting channel defining a section intersecting the flow path of the turbine exhaust which conveys said turbine exhaust from the steam turbine to the condenser, wherein said method comprises the steps of:

i) ensuring that said turbine exhaust comprises wet steam containing electrically charged water drops, and (ii) producing inside of said connecting channel an electric field having an associated current and having an average electric field strength of a predetermined value within a range of values, wherein
said electric field lies in the flow path of said turbine exhaust, and
said predetermined value is sufficiently large to reduce turbine backpressure and hence increase power output
but is small enough to avoid undesirable electrical discharges.

15. The method of claim 14 wherein step (ii) is further characterized by said predetermined value of said average electrical field strength being sufficient to fragment charged water drops in said turbine exhaust producing many small droplets, thereby providing nuclei that favor internal condensation of steam in the turbine exhaust.

16. The method of claim 14 wherein said condenser is a surface condenser including a multiplicity of heat exchange tubes wherein less than one-half of said associated current flows to electrical ground through said heat exchange tubes.

17. The method of claim 15 wherein said electric field is direct.

18. The method of claim 15 wherein said electric field is alternating having a frequency, and said frequency is less than 5 kilohertz.

19. The method of claim 15 wherein said frequency is less than one kilohertz.

20. The method of claim 15 wherein said frequency is more than 48 hertz but less than 62 hertz.

21. A steam power generating unit having an electrical ground, said steam power generating unit including a steam turbine having a turbine exhaust having a flow path, and a condenser, and a connecting channel defining a section intersecting the flow path of the turbine exhaust which conveys said turbine exhaust from the steam turbine to the condenser, wherein the improvement comprises further providing at least one active electrode insulated from electrical ground and disposed inside said connecting channel, at least one counter electrode disposed inside said connecting channel near to said active electrodes, and properly disposed walls of said connecting channel.

22. The steam power generating unit of claim 21 further provided with heated high voltage insulators which electrically insulate said active electrodes from electrical ground.

23. The steam power generating unit of claim 22 further provided with a source of direct high voltage power connected to said active electrodes.

24. The steam power generating unit of claim 22 wherein said active electrodes and said counter electrodes are linear corona electrodes and are installed in alternating sequence with a distance l between adjacent electrodes.

25. The steam power generating unit of claim 24 wherein said active electrodes and said counter electrodes are installed in a substantially coplanar arrangement.

26. The steam power generating unit of claim 25 wherein said active electrodes and said counter electrodes fill substantially an entire cross-section of said connecting channel.

27. The steam power generating unit of claim 26 wherein said condenser is a surface condenser including a multiplicity of heat exchange tubes and said active electrodes are disposed at a distance of at least 1.5 l from said heat exchange tubes.

28. The steam power generating unit of claim 27 wherein said active electrodes and said counter electrodes are cable corona electrodes.

29. The steam power generating unit of claim 28 wherein said distance l is approximately 20 cm.

30. The steam power generating unit of claim 28 wherein said counter electrodes are grounded electrodes.

31. The steam power generating unit of claim 29 wherein said active electrodes and said counter electrodes comprise a carrier string with a double wire spiral attached to it.

32. The steam power generating unit of claim 31 wherein said carrier string comprises a metallic wire.

33. The steam power generating unit of claim 31 wherein said carrier string comprises a fiberglass cord covered with silicone rubber.

* * * * *